US010488099B2

(12) United States Patent
Buda et al.

(10) Patent No.: US 10,488,099 B2
(45) Date of Patent: Nov. 26, 2019

(54) FROST DETECTION IN HVACANDR SYSTEMS

(71) Applicant: Schneider Electric USA, Inc., Andover, MA (US)

(72) Inventors: Paul R. Buda, Raleigh, NC (US); Scott R. Brown, Wake Forest, NC (US)

(73) Assignee: Schneider Electric USA, Inc., Boston, MA (US)

( * ) Notice: Subject to any disclaimer, the term of this patent is extended or adjusted under 35 U.S.C. 154(b) by 171 days.

(21) Appl. No.: 15/902,813

(22) Filed: Feb. 22, 2018

(65) Prior Publication Data

US 2019/0257568 A1 Aug. 22, 2019

(51) Int. Cl.

*F25D 21/02* (2006.01)
*F25D 21/00* (2006.01)
*F25D 21/06* (2006.01)

(52) U.S. Cl.

CPC ..... *F25D 21/02* (2013.01); *F25D 21/002* (2013.01); *F25D 21/06* (2013.01)

(58) Field of Classification Search

CPC ..... F25D 21/02; F25D 21/06; F25B 49/005; F25B 2500/19; F25B 2700/151; F25B 2700/21161; F25B 2700/21171

See application file for complete search history.

(56) References Cited

U.S. PATENT DOCUMENTS 4,495,779 A 1/1985 Tanaka et al.
5,224,354 A 7/1993 Ito et al.
5,551,248 A 9/1996 Derosier
5,867,998 A 2/1999 Guertin
6,018,958 A 2/2000 Lingelbach et al.
6,571,566 B1 6/2003 Temple et al.
6,631,617 B1 10/2003 Dreiman et al.

(Continued)

FOREIGN PATENT DOCUMENTS

EP 2918954 A1 9/2015
JP H10111050 A 4/1998

(Continued)

OTHER PUBLICATIONS

Notification of Transmittal of the International Search Report and the Written Opinion of the International Searching Authority issued in PCT Application No. PCT/US2019/018988 dated Jun. 11, 2019, 54 pages.

(Continued)

*Primary Examiner* — Emmanuel E Duke
(74) *Attorney, Agent, or Firm* — Locke Lord LLP

(57) ABSTRACT

A frost monitor for HVAC&R systems detects efficiency degradations indicative of coil icing or frosting conditions by modeling compressor input power. The model uses temperature and compressor input power parameter measurements to predict expected compressor input power parameter values. Efficiency degradations are detected by comparing compressor power or current as predicted by the model against measured power or current. Deviations of the measured power parameter values from the predicted power parameter values by a predefined threshold reflect efficiency degradations that may be due to ice or frost accumulation on system coils. Such efficiency degradations may then be used to initiate a defrost cycle in the system.

22 Claims, 10 Drawing Sheets

(56) References Cited

U.S. PATENT DOCUMENTS

| | | | | |
|---|---|---|---|---|
| 6,708,508 | B2 | 3/2004 | Demuth et al. | |
| 7,146,819 | B2 | 12/2006 | Demuth et al. | |
| 7,600,390 | B2 | 10/2009 | Manole | |
| 8,205,427 | B2 | 6/2012 | Schwarz et al. | |
| 8,800,309 | B2 | 8/2014 | Buda et al. | |
| 2004/0159113 | A1 | 8/2004 | Singh et al. | |
| 2005/0235660 | A1 | 10/2005 | Pham | |
| 2007/0163276 | A1 | 7/2007 | Braun et al. | |
| 2012/0055181 | A1* | 3/2012 | Kim | F25D 21/006 62/80 |
| 2014/0000291 | A1 | 1/2014 | Kates | |
| 2014/0000292 | A1 | 1/2014 | Kates | |
| 2014/0000293 | A1 | 1/2014 | Kates | |

FOREIGN PATENT DOCUMENTS

| | | | |
|---|---|---|---|
| JP | 2005188760 | A | 7/2005 |
| WO | 2009/038624 | | 3/2009 |

OTHER PUBLICATIONS

"How is Electricity used in US Homes", US Energy Information Administration, downloaded at https:www.eia.gov/tools/faqs/faq.php?id=96&t=3.

Annual Energy Outlook 2017, US Energy Information Administration, downloaded at www.eia.gov/aeo.

Written Opinion corresponding to International Patent Application No. PCT/US2010/059413, European Patent Office, dated Apr. 11, 2011.

International Search Report corresponding to International Patent Application No. PCT/US2010/059413, European Patent Office, dated Apr. 11, 2011.

Performance of a Residential Heat Pump Operating in the Cooling Mode with Single Faults Imposed, Applied Thermal Engineering 29(2009) 770-778, M. Kim, W. V. Payne, P. A. Domanski, S. Ho Yoon, C. J. L. Hermes, (Apr. 4, 2008).

Development of Refrigerant Charge Indicator and Dirty Air Filter Sensor, ORNL/CON-489, V.C. Mei, F.C. Chen, Z. Gao, Feb. 2003.

Virtual Refrigerant Pressure Sensors for Use in Monitoring and Fault Diagnosis of Vapor-Compression Equipment, vol. 15, No. 3., HVAC&R Research, H. Li, J. Braun, May 2009.

A Statistical, Rule-Based Fault Detection and Diagnostic Method for Vapor Compression Air Conditioners, vol. 3, No. 1, HVAC&R Research, T. Rossi, J. Braun, Jan. 1997.

Transient Characteristics of Split Air-Conditioning Systems Using R-22 and R-410A as Refrigerants, vol. 15, No. 3, HVAC&R Research, R. Kapadia, S. Jain, R. Agarwal, May 2009.

* cited by examiner

FROST DETECTION IN HVACANDR SYSTEMS

CROSS-REFERENCE TO RELATED PATENT APPLICATIONS

This application is related in subject matter to and incorporates herein by reference commonly-assigned U.S. application Ser. No. 15/902,785 entitled "DETECTION OF EFFICIENCY DEGRADATION IN HVAC&R SYSTEMS" and having Reference No. CIT-0090-US, filed concurrently herewith.

FIELD OF THE INVENTION

The disclosed embodiments relate generally to heating, ventilating, and air conditioning and refrigeration (HVAC&R) systems and, more particularly, to detecting frost conditions in such HVAC&R systems.

BACKGROUND OF THE INVENTION

HVAC&R systems, which may include residential and commercial heat pumps, air conditioning, and refrigeration systems, employ a vapor-compression cycle (VCC) to transfer heat between a low temperature fluid and a high temperature fluid. In many VCC based systems referred to as direct-exchange systems, the "fluid" is the air in a conditioned space or an external ambient environment. In other VCC based systems, including indirect-exchange systems such as chillers, geothermal heat pumps and the like, the fluid to and from which heat is exchanged may be a liquid such as water or an anti-freeze.

VCC based systems are generally known in the art and employ a refrigerant as a medium to facilitate heat transfer. The systems are mechanically "closed" in that the refrigerant is contained within the mechanical confines of the system and there is a mechanical buffer where the heat is to be exchanged between the refrigerant and the external fluid(s). In these systems, the refrigerant circulates within the system, passing through a compressor, a condenser, and an evaporator. At the evaporator, heat is absorbed by the refrigerant from the space to be cooled in the case of an air conditioner or refrigerator, and absorbed from the external ambient or other heat source in the case of a heat pump. At the condenser, heat is rejected to the external ambient in the case of an air conditioner or refrigerator, or to the space to be conditioned in the case of a heat pump.

Most VCC based systems circulate the refrigerant through coils in the evaporator and condenser to exchange heat. In an air conditioning system, the evaporator coils absorb heat from the space to be cooled and the condenser coils reject the heat absorbed by the evaporator coils to the ambient, usually the outside air. If the air conditioning system is operating in heat pump mode, then the functions of the coils are reversed and the condenser coils absorb heat while the evaporator coils reject heat to the ambient.

Coil frosting or icing can occur when condensation on the evaporator coils (which is normal and beneficial to reduce humidity in a conditioned space) freezes, significantly reducing air flow over the coils. In an air conditioning system, ice can develop on the evaporator coils for a number of reasons, including decreased airflow across the coils due to a failed evaporator fan, low refrigerant level due to leakage, and the like. Icing can cause significant reduction in system efficiency and can result in near total loss of system cooling capacity if the system continues to run while building up more ice. Most air conditioning systems are designed such that the evaporator coil will not freeze under normal conditions. However, heat pumps and refrigerators are often designed (and freezers must be designed) such that the operating evaporator coil temperature is less than the freezing temperature of water. Frosting of the evaporator coils of these systems is expected.

Most VCC based systems in which it is expected that frosting will occur on the evaporator come equipped with a means to defrost the coils. Refrigerators and freezers, for example, usually have a defrost cycle that heats the evaporator coils for a certain period of time, typically about 30 minutes. During the defrost cycle, the compressor is disabled, an evaporator heating element is energized, and a stirring fan blows air over the evaporator coils. The heating element remains energized as long as the temperature sensed by a thermostat near or on the evaporator assembly remains below a set point temperature and above the freezing point of water. This thermostat is connected in series with the heating element such that when the set point temperature is reached, a circuit opens and current to the heating element is cut. The set point temperature is selected such that under normal conditions, the evaporator temperature is significantly above the freezing point of water, which helps ensure all frost on the evaporator is melted. Stirring fans typically blow air across the evaporator coils while defrosting to ensure the resulting liquid water is removed from the coils.

Heat pumps are particularly egregious energy wasters while defrosting. Heat pumps are equipped with "reversing valves," which allow reversal of the flow of refrigerant through the system. In this way, a heat pump can operate as an air conditioner or a heater. In the air conditioning mode, the coil that functions as the evaporator is typically located within the conditioned space, while the coil serving the condenser function is located in the outdoor ambient. In the heating mode, refrigerant flow is reversed so the evaporator function is located outdoors, while the condenser function is located indoors. In the heating mode, the evaporator function often accumulates frost and this is anticipated in the design. Unlike refrigeration systems, heat pumps are generally not equipped with defrost heaters, but generally do follow a defrost cycle. To defrost the heat pump outdoor coil while heating, the system is "reversed" to operate in the air conditioning mode. The frosted coil located outside is then heated internally by the system operating as an air conditioner, which melts the frost. However, the conditioned space is being cooled during defrost, when it should be heated. To compensate, supplemental heating is applied, usually in the form of electric strip heaters. A typical heat pump system is both air conditioning and heating simultaneously while defrosting—a tremendous waste of energy.

Existing VCC based systems do not provide a way to determine when ice or frost has accumulated on the coils. The systems typically rely on an empirical model from manufacturers that is usually based on ambient temperature along with time of operation of the systems. For example, a refrigeration system may initiate a defrost cycle every 8 hours or after the compressor has accumulated 8 hours of run time regardless of whether frost has accumulated on the evaporator coils. Heat pumps may take into consideration the outdoor temperature in determining when to defrost, but not the actual condition of the evaporator coil. Such solutions tend to be conservative by design and hence energy wasteful, defrosting the coils well before it is absolutely necessary under most conditions to thereby ensure the equipment does not lose any heat transfer capacity.

Accordingly, what is needed is a way to more accurately detect when ice or frost may have accumulated on HVAC&R system coils and to defrost the coils based on such detection.

SUMMARY OF THE DISCLOSED EMBODIMENTS

The embodiments disclosed herein are directed to improved systems and methods for detecting efficiency degradation in a vapor compression cycle based HVAC&R system that may be caused by icing or frosting on the system coils. The improved systems and methods can reliably and quickly detect efficiency degradation and infer the condition of the coils, such as ice or frost accumulation, from the degradation. This allows execution of a defrost cycle to be adapted to reductions in system efficiency rather than based on a specific system on-time, a specific compressor run-time, or the like. The systems and methods employ a compressor input power parameter model that can accurately predict an expected value for one or more compressor input power parameters, such as current, and monitor a measured compressor input power parameter against the predicted value. Reductions in the power parameter value with respect to the expected value may indicate ice or frost accumulation on the system coils or occurrence of events that can lead to ice or frost on the coils, such as fan motor failures, and the like. These deviations are then used to compute a defrost discriminant that indicates a degree of efficiency degradation and thus whether ice or frost may have accumulated on the HVAC&R system coils. If the defrost discriminant is greater than a preset limit, the systems and methods trigger defrosting of the system.

The compressor input power parameter model used herein may assume several different forms, including linear, non-linear (e.g., affine), quadratic, and the like, and generally comprises one or more fluid temperature measurements and a parametric value for at least one of the fluid temperature measurements. The fluid temperature measurements may include any suitable fluid temperature measurements and the parametric values may be derived or learned from the fluid temperature measurements and measurements of a compressor input power parameter, such as current (Amps), real power (Watts), reactive power (VARS), and/or apparent power (VA). The particular compressor input power parameters measured may depend on whether the model is being used to estimate the amount of power, current, or some other power parameter being input to the compressor. In some embodiments, the particular compressor input power parameter measured is current where detection of ice or frost conditions on system coils is desired.

In one example, the model comprises (i) a baseline compressor input power parameter component, (ii) a component that reflects the sensitivity of the square of the compressor input power parameter to evaporator intake fluid temperature, (iii) a component that reflects the sensitivity of the square of the compressor input power parameter to condenser intake fluid temperature, (iv) a component that reflects the sensitivity of the square of the compressor input power parameter to the square of the evaporator intake fluid temperature, (v) a component that reflects the sensitivity of the square of the compressor input power parameter to the square of the condenser intake fluid temperature, and (vi) a component that reflects the sensitivity of the square of the compressor input power parameter to the product of the evaporator intake fluid temperature and the condenser intake fluid temperature.

In general, in one aspect, the disclosed embodiments are directed to a frost monitor for an HVAC&R system having a compressor, a condenser, and an evaporator. The frost monitor comprises, among other things, a system temperature processor operable to obtain fluid temperature measurements for the condenser and fluid temperature measurements for the evaporator, the fluid temperature measurements for the condenser and the evaporator being obtained from temperature sensors located near the condenser and the evaporator, respectively, or from proxies of the fluid temperature measurements for the condenser and for the evaporator, respectively. The frost monitor further comprises a power parameter processor operable to obtain one or more power parameter measurements for the compressor using one or more current detection devices mounted on the compressor, respectively, and a frost condition detection processor operable to provide an estimate of a compressor input power parameter for the compressor using the fluid temperature measurements and the one or more power parameter measurements. The frost condition detection processor is configured to detect degradation of operational efficiency in the HVAC&R system using the estimate of the compressor input power parameter and the one or more power parameter measurements and initiate defrosting of the HVAC&R system based on degradation of operational efficiency being detected in the HVAC&R.

In general, in another aspect, the disclosed embodiments are directed to a method of detecting coil frosting conditions in an HVAC&R system having a compressor, a condenser connected to the compressor, and an evaporator connected to the condenser. The method comprises, among other steps, obtaining fluid temperature measurements for the condenser and fluid temperature measurements for the evaporator, the fluid temperature measurements for the condenser and the evaporator being obtained from temperature sensors located near the condenser and the evaporator, respectively, or from proxies of the fluid temperature measurements for the condenser and the evaporator, respectively. The method also comprises obtaining one or more power parameter measurements for the compressor using one or more current detection devices mounted to detect current flowing into the compressor, and estimating a compressor input power parameter for the compressor using the fluid temperature measurements and the one or more power parameter measurements. The method further comprises detecting degradation of operational efficiency in the HVAC&R system using the estimate of the compressor input power parameter and the one or more power parameter measurements, and initiating defrosting of the HVAC&R system based on degradation of operational efficiency being detected in the HVAC&R.

BRIEF DESCRIPTION OF THE DRAWINGS

The foregoing and other advantages of the disclosed embodiments will become apparent upon reading the following detailed description and upon reference to the drawings, wherein.

DETAILED DESCRIPTION OF THE DISCLOSED EMBODIMENTS

Figure 1:
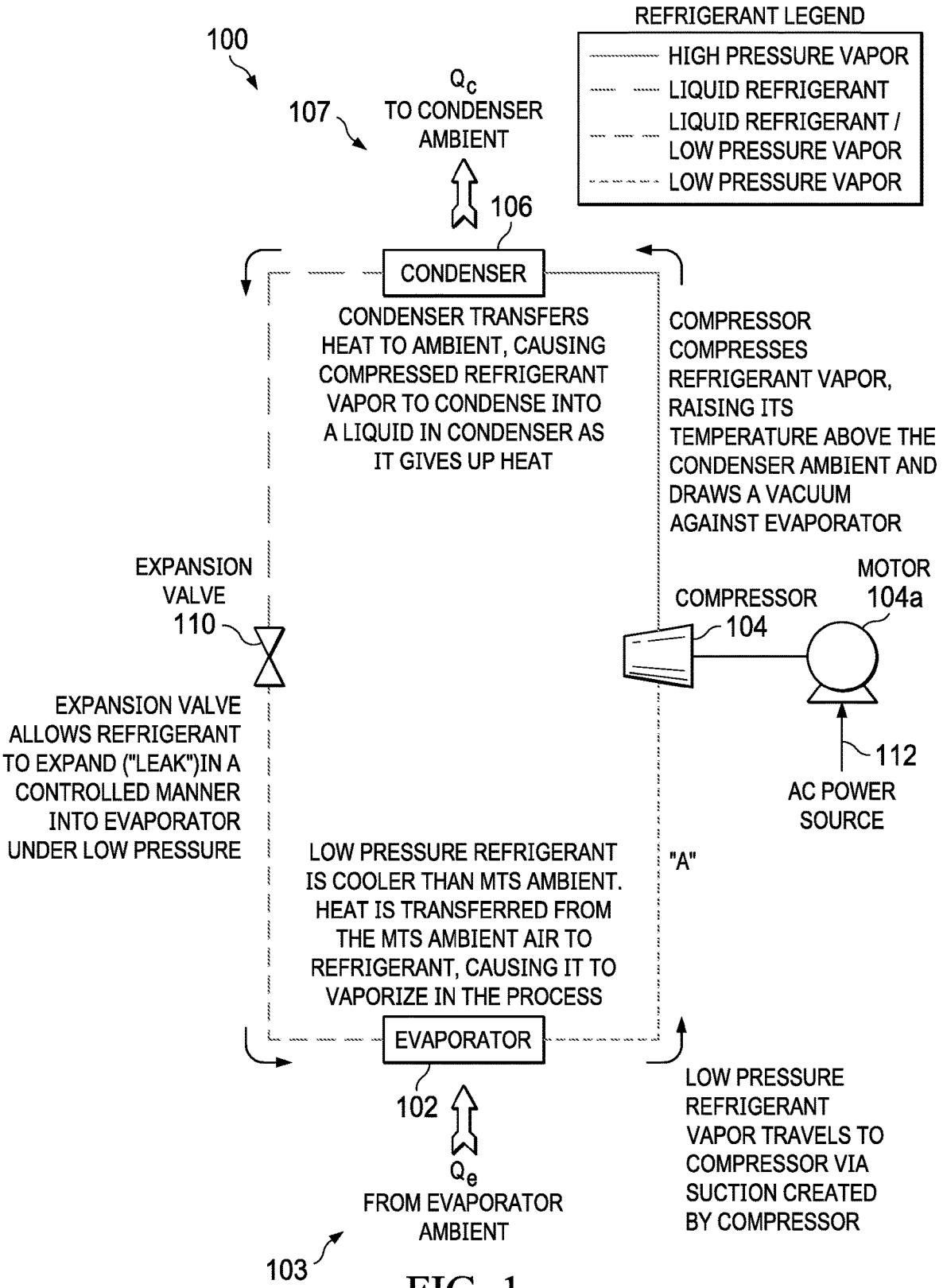
FIG. 1 (PRIOR ART)
FIG. 1 illustrates a known HVAC&R system employing a vapor-compression cycle (VCC)

As an initial matter, it will be appreciated that the development of an actual, real commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

As mentioned above, the embodiments disclosed herein relate to systems and methods for detecting efficiency degradations in HVAC&R systems that are indicative of icing or frosting conditions. The disclosed systems and methods use a compressor input power parameter model that predicts expected values for one or more compressor input power parameters, such as current, voltage, real power, reactive power, and/or apparent power, using one or more fluid temperature measurements and a parametric value for at least one of the fluid temperature measurements. For detection of icing or frosting conditions, the particular compressor input power parameter may be current. Measured (i.e., observed) values for the compressor input power parameter may then be compared against the predicted values. A decrease in the observed compressor input power parameter over the values predicted by the model indicates an instantaneous reduction in operational efficiency, one cause of which is frost build-up on evaporator coils. An increase in the observed input power parameter over the values predicted can indicate a problem with the condenser coil or condenser fan.

The above systems and methods may be used in any VCC based HVAC&R systems, including certain types of HVAC&R systems known as "direct-exchange" systems (e.g., residential air conditioning systems and most residential refrigeration systems) where air is the fluid, as well as other types of HVAC&R systems including systems known as "indirect-exchange" systems (e.g., chillers or geothermal heat pumps) where water, anti-freeze, or other types of liquids is the fluid.

In some embodiments, the compressor input power parameter model may be a static model usually intended to represent operation of the equipment when it is in a "new" or "newly maintained" condition including evaporator coils free of frosting or icing or it may be a dynamic model that is continuously or regularly updated. The latter case ensures the model reflects the most up-to-date operating condition of the HVAC&R system and accounts for any long-term degradations in the system due to loss of refrigerant, for example, that may have developed over time. The dynamic model may then be used to represent the current "expected" operating conditions for the system, even if performance is degraded by long-term effects.

Referring now to FIG. 1, a flow diagram for a basic HVAC&R system 100 is shown employing a vapor compression cycle. Operation of the HVAC&R system 100 is well known in the art and will be described only generally here. Beginning at point "A" in the figure, refrigerant in the form of low pressure vapor is drawn via suction from an evaporator 102, which is essentially a heat exchanger that absorbs heat from a fluid (i.e., air) at the evaporator ambient 103 and transfers it to the refrigerant flowing within the evaporator to a compressor 104. The compressor 104 receives the low-pressure vapor, compresses it into a high-pressure vapor, and sends it toward a condenser 106, raising the temperature of the refrigerant to a temperature higher than that of the fluid (i.e., air in the case of a direct exchange system for example) of the condenser ambient 107 in the process. At that condenser 106, condenser coils (not expressly shown) allow the heat in the higher temperature vapor refrigerant to transfer to the lower temperature condenser ambient fluid, as indicated by arrow $Q_c$. This heat transfer causes the high-pressure vapor refrigerant in the condenser coils to condense into a liquid.

From the condenser 106, the liquid refrigerant (still under high pressure) enters an expansion valve 110 that atomizes the refrigerant and releases (i.e., sprays) it as an aerosol into the evaporator 102. The temperature of the liquid refrigerant drops significantly as it moves from the inlet side of the expansion valve 110 where it is under high pressure to the outlet side of the expansion valve 110 where it is under relatively low pressure.

At the evaporator 102, the reduced temperature refrigerant cools the evaporator coils (not expressly shown) to well below the temperature of the evaporator ambient fluid in a normally operating system, absorbing heat in the process and causing the refrigerant to evaporate into a vapor. Heat from the evaporator ambient fluid flows is subsequently absorbed by the evaporator coils (not expressly shown) in the process, as indicated by arrow $Q_e$. The low-pressure vapor in the evaporator is then pulled via suction into the compressor 104 at A, and the cycle repeats.

In FIG. 1, the compressor 104 is driven by a compressor motor 104*a*, the power for which is provided by an AC power source, such as a mains AC power line 112. As will be explained in the following description, one way to detect system degradation is by monitoring the input power actually consumed by the compressor motor 104*a* over the AC power line 112 and comparing that compressor input power to the compressor input power predicted by the model mentioned above. In general, if the comparison indicates the instantaneous compressor input power is reduced from the compressor input power predicted by the model by more than a predefined threshold amount, then that may be an indication of icing or frost developing on the evaporator coils, for example, due to broken air handler fan belts or fan assemblies, faulty motor start and run capacitors, and the like.

The terms "evaporator ambient fluid" and "condenser ambient fluid" as used herein refer to the fluid of the ambient environment surrounding the evaporator and condenser functions, respectively, which may be air in the case of a direct exchange system and a liquid in other cases. When the system 100 is operating in air conditioning mode or as a refrigerator, the evaporator ambient is the space to be cooled or "air conditioned" and is normally a building or room, but may also be the internal space or food storage area of a refrigerator or freezer. In this mode, the condenser ambient is usually the outdoor environment in the case of an air conditioner and some refrigeration systems and may be the ambient external to the equipment in the case of refrigeration. In other words, a direct exchange air conditioner or refrigerator absorbs heat from the air of a conditioned space and rejects the heat to the outdoor or external environment. When the system 100 is operating as a heat pump in heating mode, the roles of the condenser 106 and evaporator 104 are reversed so that the condenser 106 functions to absorb heat from the nominally cooler outdoor environment and the evaporator 102 functions to deliver heat to the building or room being heated. Table 1 summarizes the direction of heat flow described above for air conditioning and heating systems based on the vapor compression cycle, such as the HVAC&R system 100 of FIG. 1.

TABLE 1

HVAC&R System Heat Flow

| System Function | Absorbs Heat From | Rejects Heat To |
|---|---|---|
| Air Conditioning Or Refrigeration (Including Freezer) | Conditioned Space | Outdoor or External Ambient |
| Heat Pump | Outdoor or External Ambient | Conditioned Space |

The HVAC&R system 100 of FIG. 1 is considered to be a "direct exchange" system in which heat is transferred directly to and from the air of the evaporator and condenser ambient environment by the evaporator 102 and condenser 106. However, the embodiments disclosed herein are also applicable to non-direct exchange systems, including "indirect exchange" systems, such as a chiller operating as an air conditioner, or a geothermal heat pump. In a chiller, the evaporator cools a fluid, such as cooling water, that is then transported throughout a building to independently cool the spaces therein through heat exchangers located remotely from the chiller. In some systems, heat is rejected from the condenser into a liquid fluid such as water or an anti-freeze solution, which is then transferred to a cooler ambient. Thus, the disclosed embodiments may be used with systems that transfer heat directly to and from the air of the intended spaces as in a conventional direct exchange system, or indirect exchange systems that transfer heat to or from a liquid fluid, such as water, which is then used to cool or heat the intended spaces. In what follows, the term "fluid temperature," when used to describe the intake or exhaust temperature of an evaporator or condenser (or the function thereof), will be understood to be air in the case of a direct exchange system and a liquid or fluid in the case of indirect exchange systems such as chillers. Mixed mode systems, such as a geothermal heat pump that uses water or anti-freeze to exchange heat with the ground and air to exchange heat inside the building, are also within the scope of the disclosed embodiments.

Figure 2:
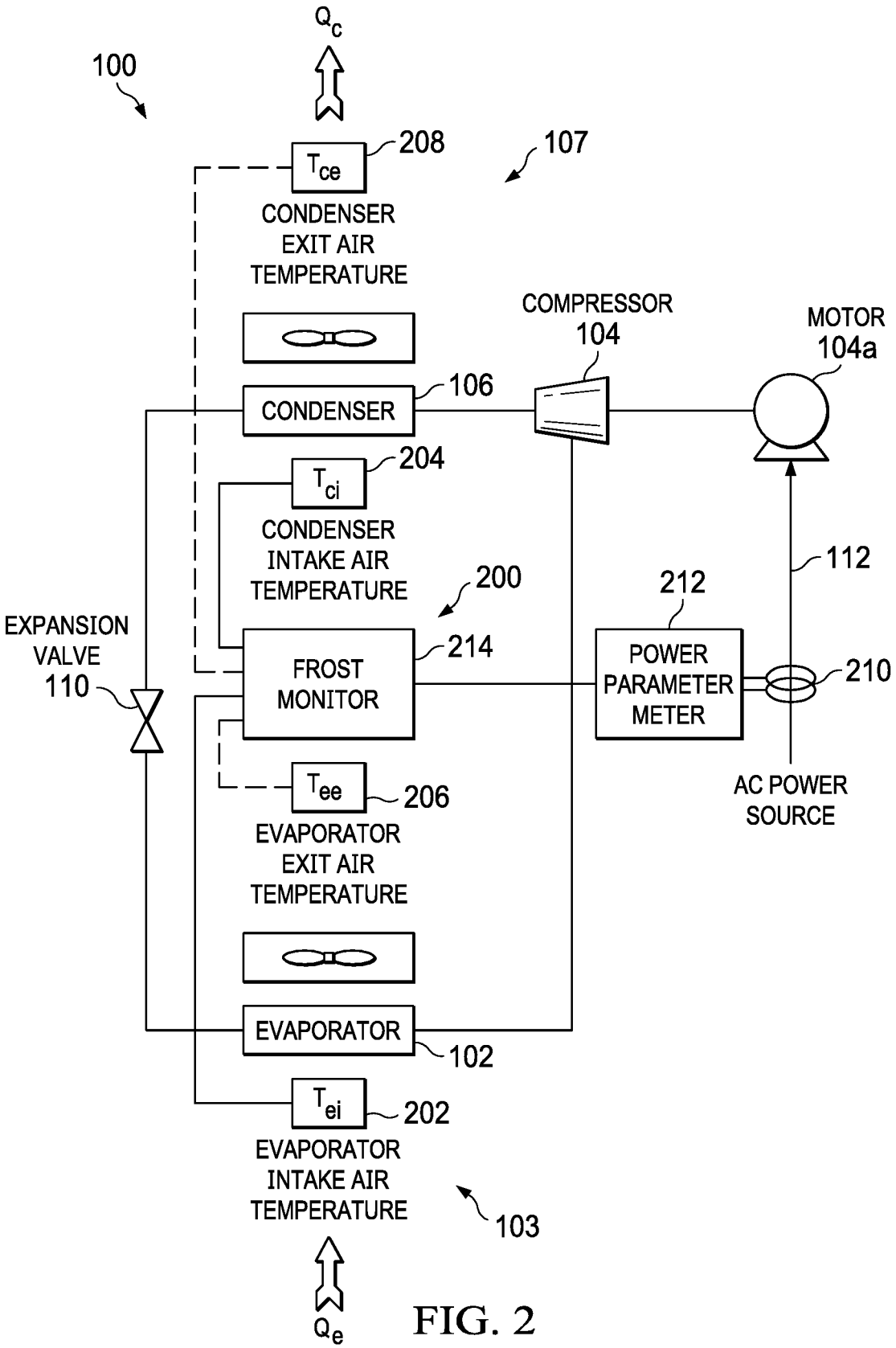
FIG. 2 illustrates an exemplary HVAC&R system having a frost monitor according to aspects of the disclosed embodiments.

Referring next to FIG. 2, an HVAC&R monitoring system 200 is shown in which the compressor input power parameter model herein may be implemented according to the disclosed embodiments. In this example, the monitoring system 200 is designed to monitor for icing or frost conditions in the HVAC&R system 100 of FIG. 1, which has now been equipped with a plurality of temperature sensors 202, 204, 206, and 208 and a frost monitor 214. In general, there are four temperatures that may be measured for the model: (i) a condenser intake fluid temperature $T_{ci}$; (ii) a condenser exhaust fluid temperature $T_{ce}$; (iii) an evaporator intake fluid temperature $T_{ei}$, generally referred to as the "return" temperature in commercial and residential direct exchange air conditioning; and (iv) an evaporator exhaust fluid temperature $T_{ee}$, generally referred to as the "supply" temperature in commercial and residential direct exchange air conditioning systems.

Although four temperatures are available, it has been discovered that the compressor input power parameter model can accurately estimate the compressor input power parameters using only two of the four temperatures: either the intake or exhaust fluid temperature of the evaporator ($T_{ei}$ or $T_{ee}$), and either the intake or exhaust fluid temperature of the condenser ($T_{ci}$ or $T_{ce}$), depending on the particular power parameter being estimated (e.g., power, current, etc.). For example, in one embodiment, the model may use the fluid temperature $T_{ei}$ at the intake of the evaporator 102 and the fluid temperature $T_{ci}$ at the intake of the condenser 106 to estimate the power parameter. Accordingly in one embodiment, a temperature sensor 202 is mounted at or near the intake of the evaporator 102 to measure the evaporator intake fluid temperature $T_{ei}$, and a second temperature sensor 204 is mounted at or near the intake of the condenser 106 to measure the condenser intake fluid temperature $T_{ci}$. Alternatively, the condenser exhaust fluid temperature $T_{ce}$ may be substituted for $T_{ci}$ or the evaporator exhaust fluid temperature $T_{ee}$ may substituted for $T_{ce}$ in some embodiments. In such embodiments, a third temperature sensor 206 may also optionally be mounted at the exhaust of the evaporator 102 to measure the evaporator exhaust fluid temperature $T_{ee}$, or a fourth temperature sensor 208 may also optionally be mounted at the exhaust of the condenser 106 to measure the condenser exhaust fluid temperature $T_{ce}$. These temperature sensors 202, 204, 206, and 208 may be any suitable temperature sensors known to those skilled in the art, including voltage-based temperature sensors that employ thermocouples or thermistor devices.

In addition to the intake fluid temperature measurements, measurements of a compressor input power parameter are also obtained for monitoring the system HVAC&R 100. Examples of compressor input power parameter measurements that may be obtained include measurements of current, voltage, real power, reactive power, and apparent power. As discussed further below, where the system 100 is being monitored for ice or frost conditions on the evaporator coils, the power parameter measurement is typically current, due to the relatively low equipment cost contrasted with power meters and the like. And as a practical matter, for measurements of real power, most power meters and other power measurement devices also need to measure current. Thus, compressor input current is almost always one of the compressor input power parameters measured.

In a typical residential installation, the compressor 104 (and motor 104*a*) is fed by a mains AC power line 112, which may be a 3-wire single-phase power line having a mid-point neutral. Other configurations are also possible, including two-wire AC systems and 3-phase AC configurations. Thereafter, one or more current detection devices 210, such as one or more toroidal-type current transformers, may be mounted on the wires of the compressor power line 112. The outputs of the one or more current transformers 210 are then provided to a power parameter meter 212, which may be any commercially available power meter or a meter that can measure RMS current flowing through the power line 112. Some models of the power parameter meter 212 may also incorporate measurements of line voltage, such as models that measure real power and apparent power (Volt-Amps), in single or polyphase form. An example of a commercial power meter that may be used as the power parameter meter 212 is the POWERLOGIC® PM850 power meter from Schneider Electric USA, Inc. This meter is capable of continuously measuring, among other things, the real power, reactive power, apparent power, voltage, and current delivered to the compressor 104, provided the appropriate connections (e.g., voltage and current connections) are made to the meter.

In frost or ice monitoring embodiments where the compressor input power parameter model is being used to estimate compressor input current, one or more current transformers and other current-measuring devices may be used instead of a power meter. Current-measuring devices are available that can provide an indication of the RMS current flowing through the power line 112 over a specified current range. Such current-measuring devices are particularly suited for use with a current-based model, as no mains voltage measurements are required in order to estimate compressor input current. In these embodiments, the RMS current delivered to the compressor 104 alone may suffice as the compressor input power parameter measurements for the model. An example of current-measuring device suitable for some HVAC&R applications is a Veris H923 split-core current sensor from Veris Industries that can provide a 0-10 Volt signal in response to a 0-10 Amp RMS current. Other similar current-measuring devices or systems may be employed, appropriate to the expected levels of current in the system.

The measured current or other compressor input power parameter measurements may then be used along with either the intake or exhaust fluid temperature of the evaporator ($T_{ei}$ or $T_{ee}$), and either the intake or exhaust fluid temperature of the condenser ($T_{ci}$ or $T_{ee}$), to establish the model. In some embodiments, and by way of an example only, the particular fluid temperature measurements used may be measurements of the evaporator intake fluid temperature $T_{ei}$ and the condenser intake fluid temperature $T_{ci}$. This is the arrangement depicted in FIG. 2. In other implementations, the fluid temperature measurements used may be measurements of the evaporator exhaust fluid temperature $T_{ee}$ and the condenser exhaust fluid temperature $T_{ce}$. In still other implementations, a combination of condenser intake and evaporator exhaust temperatures may be used, or a combination of condenser exhaust and evaporator intake temperatures may be used.

The fluid temperature measurements (from the sensors 202, 204, 206, and/or 208) along with the compressor input power parameter measurements (from the power parameter meter 212) may then be provided to the frost monitor 214 for modeling the compressor input and detecting system degradation indicative of ice or frost accumulation. These measurements may be provided to the frost monitor 214 over any suitable signal connection, including wired (e.g., Ethernet, etc.), wireless (e.g., Wi-Fi, Bluetooth, etc.), and other connections. Such a frost monitor 214 may be integrated into a refrigeration controller for a refrigeration system or a so-called "smart" thermostat for an air conditioning system, or other programmable thermostat that is capable of being configured to input a plurality of data signals (e.g., analog, digital, etc.), executing an algorithm or software routine based on those data signals, and outputting one or more data signals (e.g., analog, digital, etc.). Other examples of commercially available devices that may be adapted for use as the frost monitor 214 are commercially available programmable logic controllers (PLC), and building management systems (BMS), both manufactured by Schneider Electric Co. Cloud-based solutions where a portion or all of the frost monitor 214 resides on a remote network location are also contemplated by the disclosed embodiments.

Figure 3:
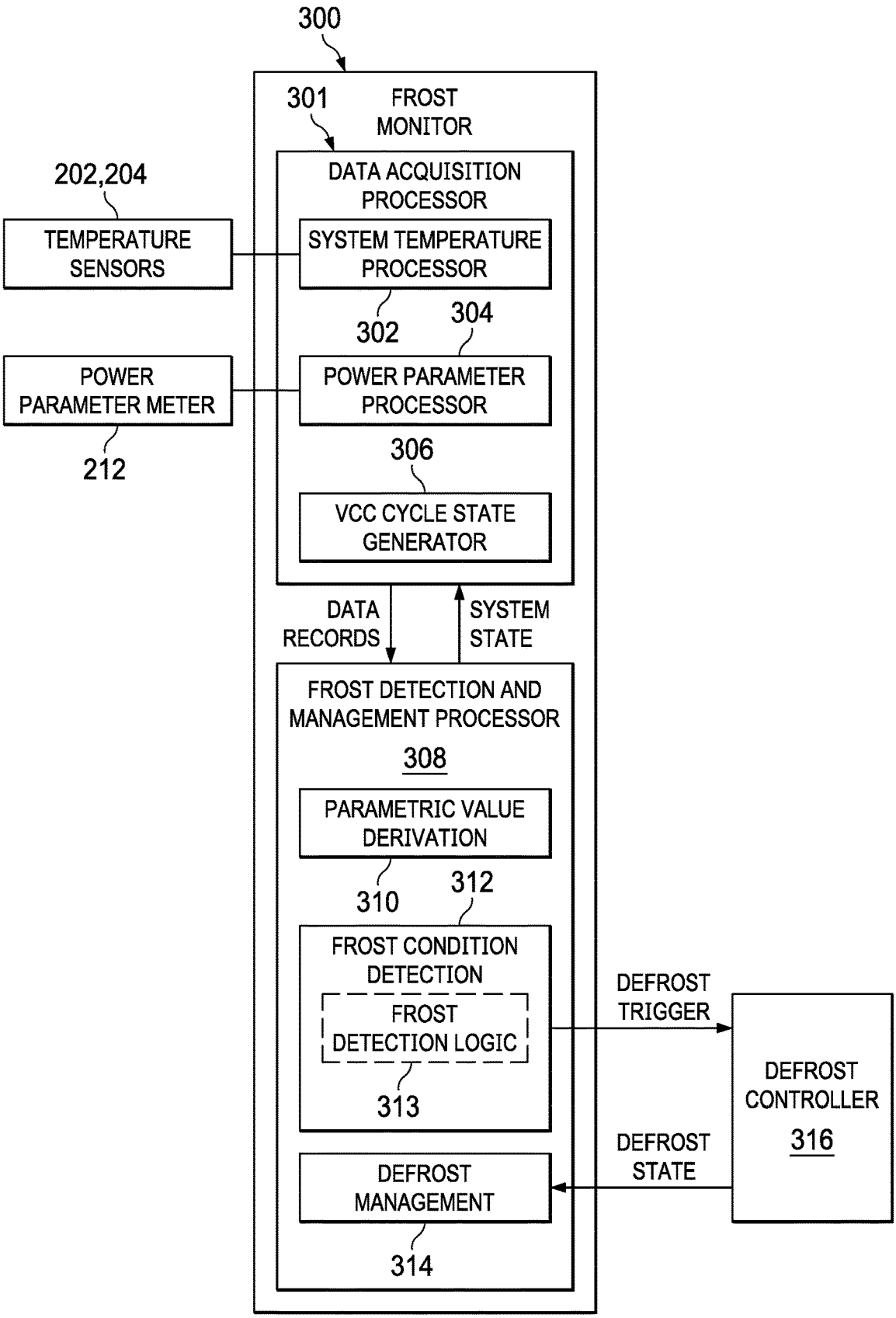
FIG. 3 illustrates an exemplary implementation of a frost monitor according to aspects of the disclosed embodiments.

FIG. 3 illustrates an exemplary implementation of a frost monitor 300 that may be used as the frost monitor 214 in FIG. 2. The frost monitor 300 may be composed of several processing circuits, including a data acquisition processor 301 and a frost detection and management processor 308, each processing circuit having a number of sub-processing circuits that are discussed in more detail further below. Each of these processing circuits 301 and 308 (and their sub-processing circuits) may be either a hardware based processing circuit (e.g., ASIC, FPGA, etc.), a software based processing routine (e.g., algorithm, etc.), or a combination of both hardware and software (e.g., microcontroller, etc.). In addition, while the processing circuits 301 and 308 (and their sub-processing circuits) are shown as discrete components, any of these components may be divided into several constituent components, or two or more of these components may be combined into a single component, without departing from the scope of the disclosed embodiments. Following is a description of the operation of the various processing circuits 301 and 308 (and their sub-processing circuits).

As used herein, the term "circuits" and "circuitry" may refer to one or more or all of the following: (a) hardware circuit implementations (such as implementations in analog and/or digital circuitry); (b) combinations of hardware circuits and software, such as a combination of analog and/or digital hardware circuit(s) with software/firmware, or any portions of hardware processors with software (such as digital signal processors), software, and memories that work together to cause a system, device, or apparatus to perform various functions); and (c) hardware circuits and or processors, such as a microprocessor or a portion of a microprocessor, that requires software (e.g., firmware) for operation, but the software may not be present when it is not needed for operation.

The data acquisition processor 301 operates to acquire and store fluid temperatures and power parameter values continuously and from these values and optionally other inputs, synthesizes HVAC&R system state information, and assembles and pre-processes them into data records that can be used by the frost detection and management processor 308. In the example shown, the data acquisition processor 301 includes a system temperature acquisition processor 302 which operates to acquire and store fluid temperature measurements for the model, either continuously or regularly. The data acquisition processor 301 also includes a power parameter acquisition processor 304 which acquires and stores measurements of one or more compressor input power parameters as measured by the power parameter meter 212 (see also FIG. 2), continuously or regularly. These one or more compressor input power parameters may include real power, reactive power, apparent power, voltage, and current consumed by the compressor 104. For purposes of monitoring for the presence of icing or frost conditions where the model is being used to predict compressor input current, the one or more compressor input power parameters may be measurements of the RMS current delivered to the compressor 104.

The data acquisition processor 301 assembles temperature estimates from the system temperature acquisition processor 302 and the power parameter acquisition processor 304 for inclusion in data records or tuples that represent the state of the equipment at a point or over an interval of time. Certain state information regarding the operation of the VCC cycle can be derived by observing the sequence of data measurements as they are made, and a VCC cycle state generator 306 is included to provide or synthesize this information.

Figure 4:
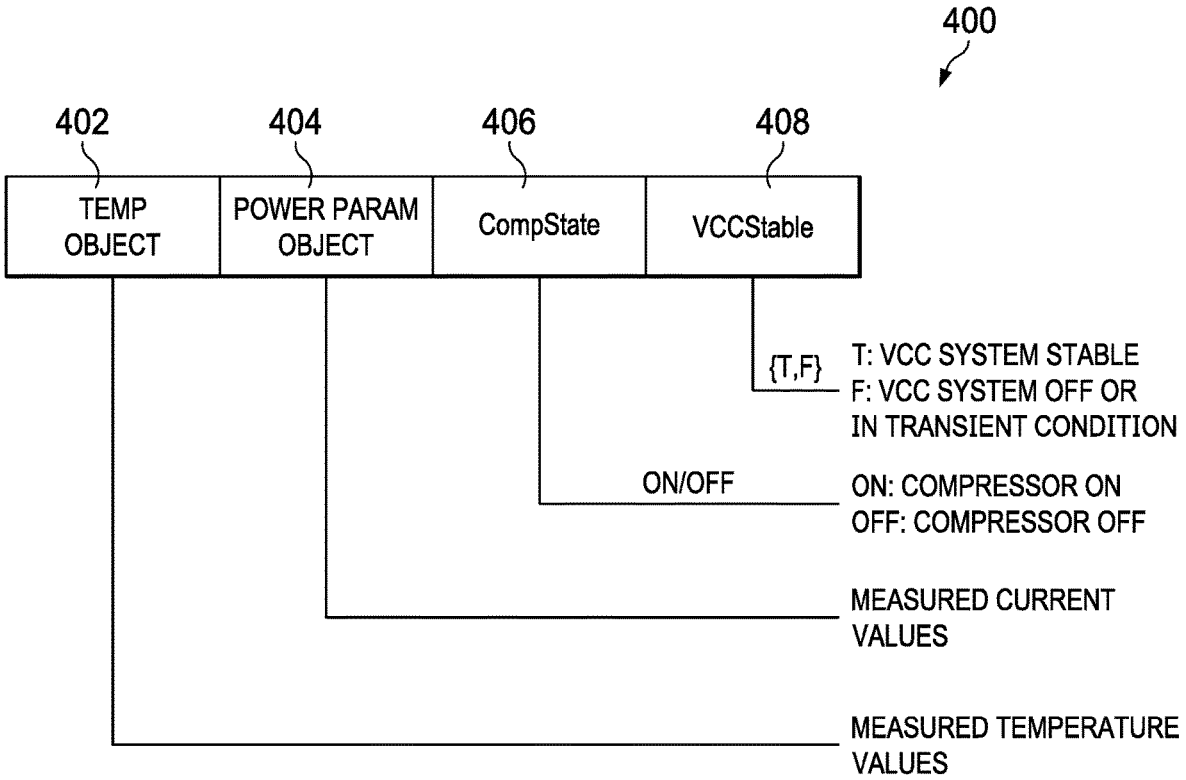
FIG. 4 illustrates an exemplary data record that may be used by a frost monitor according to aspects of the disclosed embodiments.

FIG. 4 provides an example of a data record 400 for a frost monitor according to the disclosed embodiments. One element of the exemplary data record 400 is a temperature object 402 comprising a collection of temperature measurements from the equipment taken proximately in time. In the present example, the fluid temperatures being measured and processed (or preprocessed) by the temperature acquisition processor 302 and incorporated in the temperature object 402 of the data record are the evaporator intake fluid temperature $T_{ei}$ and the condenser intake fluid temperature $T_{ci}$. These fluid temperature measurements are acquired from the temperature sensors 202 and 204 located at or near the evaporator and condenser intakes, as shown in FIG. 2. In other examples, the evaporator exhaust temperature $T_{ee}$ and the condenser exhaust temperature $T_{ce}$ may be the fluid temperature measurements acquired and preprocessed by the system temperature processor 302. Alternatively, room temperature measurements (e.g., from a thermostat) may be used as a proxy for measurements of the evaporator intake fluid temperature $T_{ei}$ rather than directly measuring the evaporator intake fluid temperature $T_{ei}$ in direct exchange air conditioning applications or as a proxy for the condenser intake fluid temperature $T_{ci}$ in heat pump applications and many refrigeration systems. In refrigeration applications (including freezers), the temperature of the internal compartment directly cooled by the evaporator may be used as a proxy for evaporator intake temperature. Other temperature proxies that track or are suitably responsive to the various intake and exhaust temperatures discussed herein may also be used without departing from the scope of the disclosed embodiments. These include, but are not limited to use of measured outdoor temperature or temperature estimates obtained from weather services or forecasts.

The data record 400 can include in some embodiments a temporally associated power parameter object 404, which comprises a measurement of one or more power parameters that were measured (by the power parameter meter 212) proximate in time to the measurements in the corresponding temperature object 402. An example of a power parameter than can be provided by the power parameter acquisition processor 304 of FIG. 3 and included in the data record of FIG. 4 is the compressor input current I. In some embodiments, the system temperature acquisition processor 302 and the power parameter acquisition processor 304 may provide processed or filtered values of these parameters, for instance, the average values of these parameters over a 10-second interval, or over the steady state portion of a compressor on-cycle (i.e., the period when the compressor is actively moving refrigerant through the HVAC&R system).

In some embodiments, the VCC cycle state generator 306 of the data acquisition processor 301 in FIG. 3 provides logic to augment the temperatures and power parameters of the data record of FIG. 4 with VCC system state information useful to the frost detection and management processor 308. For instance, in managing a timed defrost cycle based on compressor run time, it can be useful to associate the state of the compressor (on or off) at the time of the temperature and power parameter measurements. The state of the compressor can often be obtained from an HVAC&R controller such as a thermostat, programmable logic controller, building management system, and the like that can expose the commanded on or off state of the compressor or compressors, but can also be inferred from monitoring a power parameter. In the example of FIG. 4, the state of the compressor {On or Off} at the time of the temperature and power parameter measurements is captured as the state variable CompState 406 in the data record 400.

Prediction of the compressor input power parameter using the embodiments described herein is most accurate after the VCC cycle has been operational long enough that refrigerant states have stabilized in the system. While the actual time required to stabilize refrigerant states can vary dependent upon the equipment, stabilization generally occurs within about 3-5 minutes of operation. For the VCC cycle state generator 306 that can detect whether the compressor is on or off, appropriate logic or circuitry may be implemented to synthesize a state variable indicating that the VCC cycle should be stable. As one example, logic may be implemented to declare the VCC cycle stable when the compressor has been detected on for longer than a contiguous interval of, for instance, 5 minutes. Otherwise, the VCC cycle can be declared not stable. To this end, a state variable VCCStable 408 may be included in the data record 400 shown in FIG. 4, which variable may be a Boolean variable that takes values in the set {True, False}, where the value "True" indicates that the VCC cycle is stable using logic similar or identical to that described. In this state, it can be expected that a properly trained compressor input power parameter model will accurately predict the power parameter(s) in the absence of significant frosting or other conditions that would cause system degradation. When the VCCStable state variable takes on the value "False," it means that either the VCC system is not operating (compressor is off), or that the compressor is on but the system has not been operational long enough for the refrigerant states to stabilize. In this False state, the compressor input power parameter model should not be trusted to provide an accurate prediction of the power parameter (which may be current in this example).

The data records 400 assembled by the data acquisition processor 301 are then provided to the frost detection and management processor 308 for use in monitoring the HVAC&R system, as shown in FIG. 3. The frost detection and management processor 308 is responsible for learning and maintaining the parametric values for the model of the power parameters used to predict power parameter values, using the model to determine when system efficiency is degraded due to frosting, and triggering the defrost cycle when appropriate. The compressor input processor 308 may also issue an audio/visual warning and/or an alert message (e.g., e-mail, text, etc.) to the appropriate personnel in some embodiments.

In accordance with the disclosed embodiments, the frost detection and management processor 308 may include processing circuits that operate to derive or learn the model parametric values and monitor for efficiency degradation indicative of possible icing or frost on the system coils. For example, the frost detection and management processor 308 may include a parametric value derivation processor 310, a frost condition detection processor 312, and a defrost management processor 314. The parametric value derivation processor 310 is responsible for learning and maintaining the parametric values of a compressor input power parameter model used to predict the power parameter values. The frost condition detection processor 312 applies the model to the information contained in data records to determine when and if the performance of the HVAC&R system has degraded due to frosting to an extent that a defrost cycle is required and triggers that defrost cycle. The defrost management processor 314 manages the defrost cycle. These processing circuits 310-314 work in conjunction with one another to enable the frost detection and management processor 308 to detect efficiency degradation indicative of icing or frost conditions in the HVAC&R system and begin defrosting the system based on such detection.

In the example, the frost detection and management processor 308 of the frost monitor 300 maintains several state variables to facilitate management of the frost detection and defrost process. A global system state variable, herein referred to as SysState, is maintained as will be described, indicating whether the HVAC&R system is in a normal refrigeration cycle, or an active defrost cycle. SysState takes on values in the set {Defrost, Normal}, where the value "Defrost" means that the defrost controller is actively executing a defrost cycle. In this state, the compressor input power parameter model is not expected to provide valid predictions of compressor power for the purpose of frost detection. The SysState value "Normal," refers to the normal operation of the equipment in which frost detection may be needed.

In some embodiments, the frost monitor 300 may learn the parametric values required for the model from observations of the equipment operation via data records (see FIG. 4). Until the frost monitor has learned the parametric values, an alternative defrost strategy referred to herein as a "bootstrap" process may be employed. In the example, a global state variable named "LearnRun" is employed to facilitate this. The state variable LearnRun takes values in the set {Learn, Run}, with "Learn" indicating that the frost monitor is developing the parametric model and the alternative defrost strategy is employed, and "Run" indicating that the model is available for subsequent use. This state variable is initialized to the value "Learn" initially.

In some embodiments, a pre-defined interval immediately following a defrost cycle and referred to herein as a "defrost recovery interval" is used to facilitate identification of data records suitable for training or updating the model. In the absence of a failure in the defrost cycle, the equipment can be assumed to be frost-free over this interval. When the defrost recovery interval is used, selection of the interval may be done using any suitable criteria, but an interval of 2 hours of calendar time may be considered typical. In the example, a global state variable "Recovery" is maintained. This is a Boolean variable taking values in the set {True, False}, with "True" indicating that the system is within the pre-defined interval since the end of the last defrost cycle and "False" indicating that it is not.

The parametric value derivation processor 310 functions to automatically derive or learn the parametric values for the model from data records received from the data acquisition processor 301. The parametric value derivation processor 310 may perform this function by automatically applying well-known numerical methods. For example, the parametric value derivation processor 310 may apply a parameter fitting method such as regression analysis or constrained optimization to a data set assembled by the parametric value derivation processor 310 from data records received from the data acquisition processor 301. In a typical arrangement, one or more data sets of data records processed (or preprocessed) as explained above are assembled over time by the parametric value derivation processor 310 from data records received from data acquisition processor 301 as training and validation data sets for purposes of "learning" appropriate parametric values of the one or more compressor input power parameter models. From these data sets, the parametric value derivation processor 310 automatically derives or learns the parametric values needed for the model. In some embodiments, the parametric values need to be learned only once for a model to work and no subsequent updates to the values are needed, in which case the model is considered to be a static model. It is of course possible to update the parametric values from time to time as needed or on a continuous basis, in which case the model is considered to be a dynamic model that represents the most recent operation condition of the equipment. In this case, the parametric value derivation processor 310 can assemble updated data sets from data records as needed.

Preferably the one or more data set(s) used to derive or learn the parametric values was obtained while the evaporator coils are unfrosted or otherwise in good operating condition to ensure the best accuracy of the model. As described above, the state variable "Recovery" managed by frost detection and management processor 308 is set True in an interval immediately after a defrost cycle, where it can be assumed that the evaporator coil is frost-free. This state variable is managed by the defrost management processor 314 in a manner to be described subsequently. Until a working model is available, an initial "bootstrap" process may be used where the HVAC&R system is deliberately defrosted more often than normally needed while the parametric value derivation processor 310 builds the initial data set(s) for training the model. Managing this bootstrap process is one of the functions of the defrost management processor 314. Once the parametric model is learned, defrost based on frost detection as disclosed herein can commence. Thereafter, if a dynamic model is used, data may be obtained during the interval immediately after a defrost, 2 hours for example, to update the parametric values, as the measured power parameters should track the predicted values reasonably well during such interval. As mentioned above, this interval is referred to herein as a defrost recovery cycle. If there is a significant deviation between the measured and predicted values during such interval, then this may be an indication of a problem in the defrost system. Identifying this interval to the frost detection and management processor 308 is the responsibility of the defrost management processor 314, which manages the value of the state variable "Recovery" described above.

In some embodiments, two or more versions of the model may be maintained, for example, one version based on data sets for a heat pump system operating in heating mode and another version based on data sets for the same system operating in air conditioning mode and an optional system state variable can be maintained by the frost monitor indicating the present mode (heating or cooling) of the system. The compressor input processor 308 then uses the model appropriate to the mode to monitor for efficiency degradation indicative of icing or frost conditions in the system. If such system degradation is detected, then the compressor input processor 308 may send a signal to an appropriate system component, such as a defrost controller 316, of the refrigeration controller or the smart thermostat, and the like, to begin defrosting the system.

Figure 5:
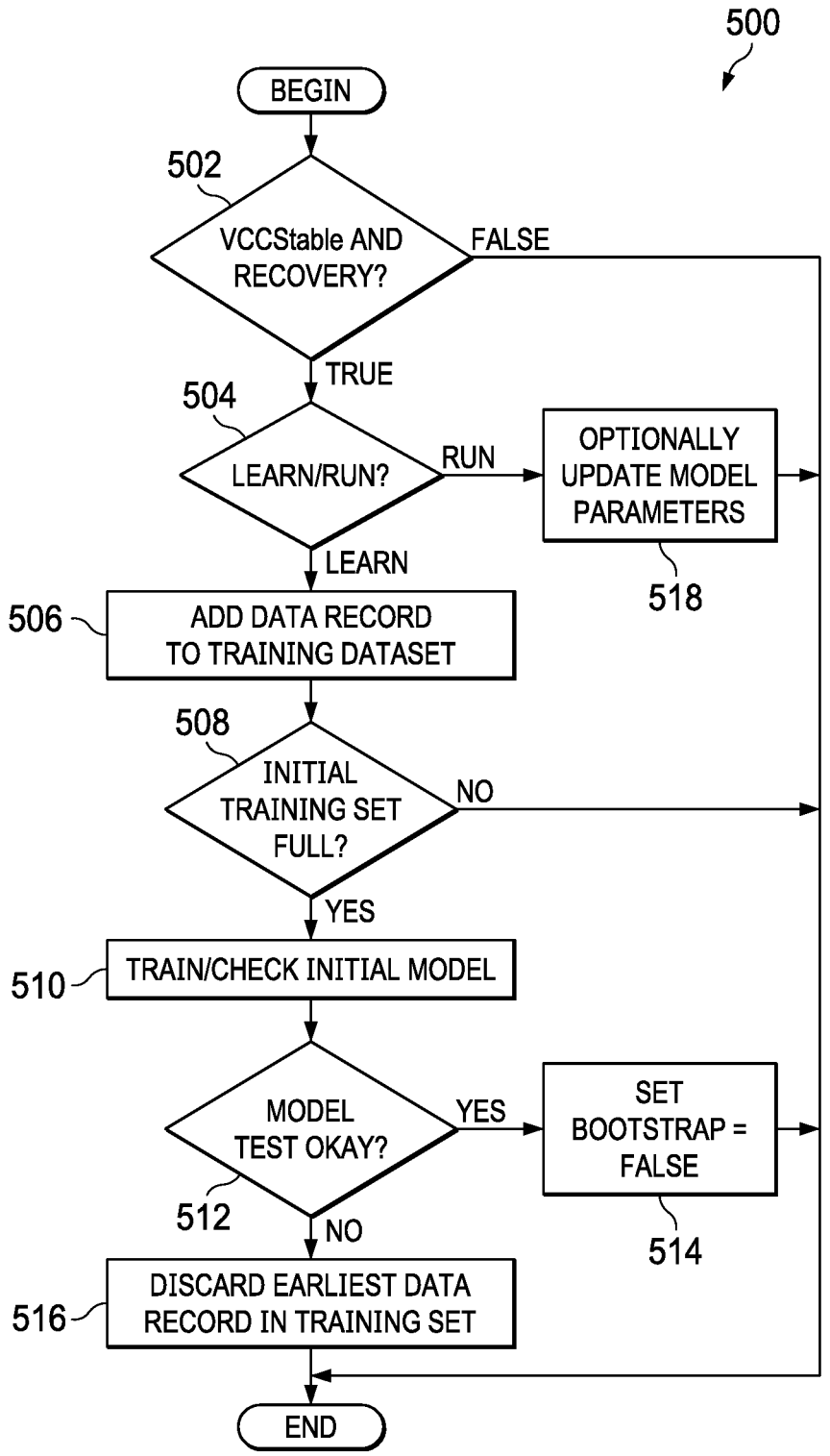
FIG. 5 illustrates an exemplary method that may be used to derive model parametric values according to aspects of the disclosed embodiments.

FIG. 5 shows a flow chart 500 describing an exemplary implementation of the parametric value derivation processor 310 in some embodiments. In general, the parametric value derivation processor 310 assembles a data set from the data records received from the data acquisition processor 301, then applies conventional curve-fitting techniques to the data set to derive initial parametric values. Referring to FIG. 5, upon entry to the flow chart with a new data record at decision block 502, the parametric value derivation processor 310 tests the state variables of the data record to determine whether data record may be used for training the model. In the example, to be a valid data record to facilitate model training, the data record should indicate that the VCC cycle is stable (VCCStable=True in FIG. 4) and the data record should lie within the defrost recovery interval (Recovery=True), as this represents the pre-defined interval in which it has been determined by experiment or experience that the data record likely represents stable, frost-free operation of the HVAC&R system. If either of these state variables contained in the data record are False, the present data record does not represent potential training data and the process exits normally.

Assuming the result of the testing in decision block 502 is True, the data record represents potential training data and control passes to decision block 504, which tests to see if the frost monitor is in the "Learn" or "Run" mode from the value of the LearnRun state variable. Upon startup of the frost monitor, the LearnRun global state variable is set to the value "Learn," indicating that no parametric values for the model yet exists. If at decision block 504 the LearnRun state variable has the value "Learn," the frost monitor has not yet learned the parametric values corresponding to the compressor input power parameter model. In this case, in process block 506 the parametric value derivation processor appends the data record to an initial data set, which is a collection of data records to be used in training the model. Then, in decision block 508, the size of the initial data set is checked to see if there are enough data records in the training set to train an initial model. If there are enough data records (the "Y" path from decision block 508), the parametric value derivation processor proceeds to train the model and check it to ensure it does an adequate job of modeling the training data. In some embodiments, as is common in machine learning applications, the initial data set is divided into a training data set and a validation data set, in which the parameters are derived using the training data set and the resulting parameters used to test the ability of the resulting model to accurately predict the power parameter values in the validation data set. In decision block 512, if the model is properly trained and validated, the model is declared ready for use for frost detection and mitigation (the "Y" path) and in process step 514, the "Bootstrap" state variable is set to False, indicating so, and the process is complete for the present data record.

If in decision block 512, it is determined that the resulting model is not properly validated, the parametric value derivation processor continues to gather data records. In the example shown, it does so by discarding or "throwing out" the temporally oldest data record in the initial data set in process block 516 and the process is complete for the present data record.

In some embodiments employing a static model, once a set of model parametric values has been properly derived (the state variable Learn/Run is set to "Run" in process block 514), the model parametric values remain fixed and no further work is done by parametric value derivation processor 310. Alternatively, in other embodiments, the parametric value derivation processor 310 can optionally use data records in which the VCC cycle is stable and the data record lies temporally within the defrost recovery window per decision block 502 to continue to update the model. Referring back to decision block 504 in FIG. 5, if the state variable Learn/Run has the value "Run," control passes to process block 518 where the parametric value derivation processor 310 can optionally use the data record to update the model in a so-called dynamic model. Once this optional modeling update is complete in process block 518, the routine ends normally.

Expanding on process block 510 (and 518) of FIG. 5, methods of regression analysis and curve fitting data to a specific model are well understood and numerous textbooks and references exist on the subject. Commercially available mathematical analysis software like MATLAB and programming languages like Python typically contain curve-fitting tools (e.g., "scipy.optimize.lsq_linear" for Python) that can readily perform the analysis when appropriately applied by a person skilled in the art of data analysis. These tools allow the parametric value derivation processor 310 to constrain the parametric values to within certain numerical ranges in order to ensure the resulting model makes sense from a physical, real world perspective. As an example of such a constraint, an increase in either evaporator or condenser intake fluid temperature should not result in a decrease in the magnitude of the compressor input power parameter. This implies that the parametric values should be non-negative in an affine form of the power parameter model, for example. Using such tools, a fit may be performed on the sets of data, for instance, to minimize mean-square error to obtain the parametric values for the model, possibly subject to constraints that may be placed on the parameters due to the physics of the system as appropriate.

Initially, the parametric value derivation processor 310 may derive or learn the parametric values from known data sets that are obtained under nominal operating condition (i.e., a stable system), or during a "bootstrap" process (as mentioned above). These are data sets that are obtained when the HVAC&R system is new or well-maintained and there are no internal system errors or equipment faults. Such initial data sets allow the parametric value derivation processor 310 to establish initial starting points for the parametric values. In other implementations, it is also possible to use a default set of values as the starting points for the parametric values. Such a default set of values may be obtained, for instance, by statistical modeling of a group or series of similar or identical HVAC&R systems. In this case, the value of the Learn/Run state variable can initially be set to "Run," and the parametric values updated using subsequent data records.

Expanding upon process block 518, in many systems no updates to the parametric values beyond the initial values are required for proper operation of the compressor input processor 308. However, in some embodiments, updated parametric values may be derived or learned by the parametric value derivation processor 310 using new data records or data sets from data acquisition processor 301. These updates may occur on a scheduled basis, such as every few seconds, minutes, hours, and the like, may occur as the result of an event, such as an interval following a defrost cycle, or they may occur on a real-time or near real-time basis as additional data becomes available. This helps ensure the model is up-to-date and reflects the current "normal" operating conditions of the system, including any slow or long-term degradations that may have developed in the system over time. Preferably the data records used to update the parametric values are obtained during the defrost recovery cycle as discussed above, in which the "Recovery" state variable is True as the measured power parameters should track the predicted values reasonably well during this interval.

Updating the parameters of the model in process block 518 can take on many forms, including one in which the temporally oldest data record in the initial data set is replaced by the present record until all the data records in the initial data set have been replaced by new records, at which time a new initial data set is declared and the model is re-trained using this new initial data set. As an alternative, in systems in which the compressor cycles on and off to control temperature in what is commonly referred to as "bang-bang" control, the model parametric value derivation processor 310 may compute summary statistics comprising, for example, the mean measured temperature and mean compressor input power parameter over the "steady state" portion of a compressor on-cycle as a summary data record. Other variations on this approach are also contemplated, such as computing summary statistics on fixed-length subsets of samples of the temperatures and input power parameter values (e.g., 5-minute "chunks" of tuples of measurements, each taken at 1 second intervals.

As another alternative, the parametric value derivation processor 310 may implement one or more commonly-known adaptive filters, such as a recursive least squares (RLS) filter, in which the filter coefficients directly represent the parametric values of the model. An RLS filter of the appropriate form may be used to estimate the parametric values of the model without using all of the optimization techniques mentioned above. Such an RLS filter may be a particularly effective way to implement an adaptive filter in certain circumstances, for example, in controllers (e.g., PLC) with limited mathematical processing capability or memory. In this embodiment, the data acquisition processor 301 would provide the parametric value derivation processor 310 with filtered temperature and power parameter data records known or assumed to represent the system in a frost-free state. Care would need to be taken to filter the temperature and power parameter inputs to the model in order for its parametric values to not be too noisy, but these are skills well understood by designers of adaptive filters.

Other suitable updating schemes may also be used to update the model parametric values without departing from the scope of the disclosed embodiments. The particular updating scheme used, which may change depending on the specific requirements of the implementation, is not overly important to the practice of the disclosed embodiment.

Figure 6:
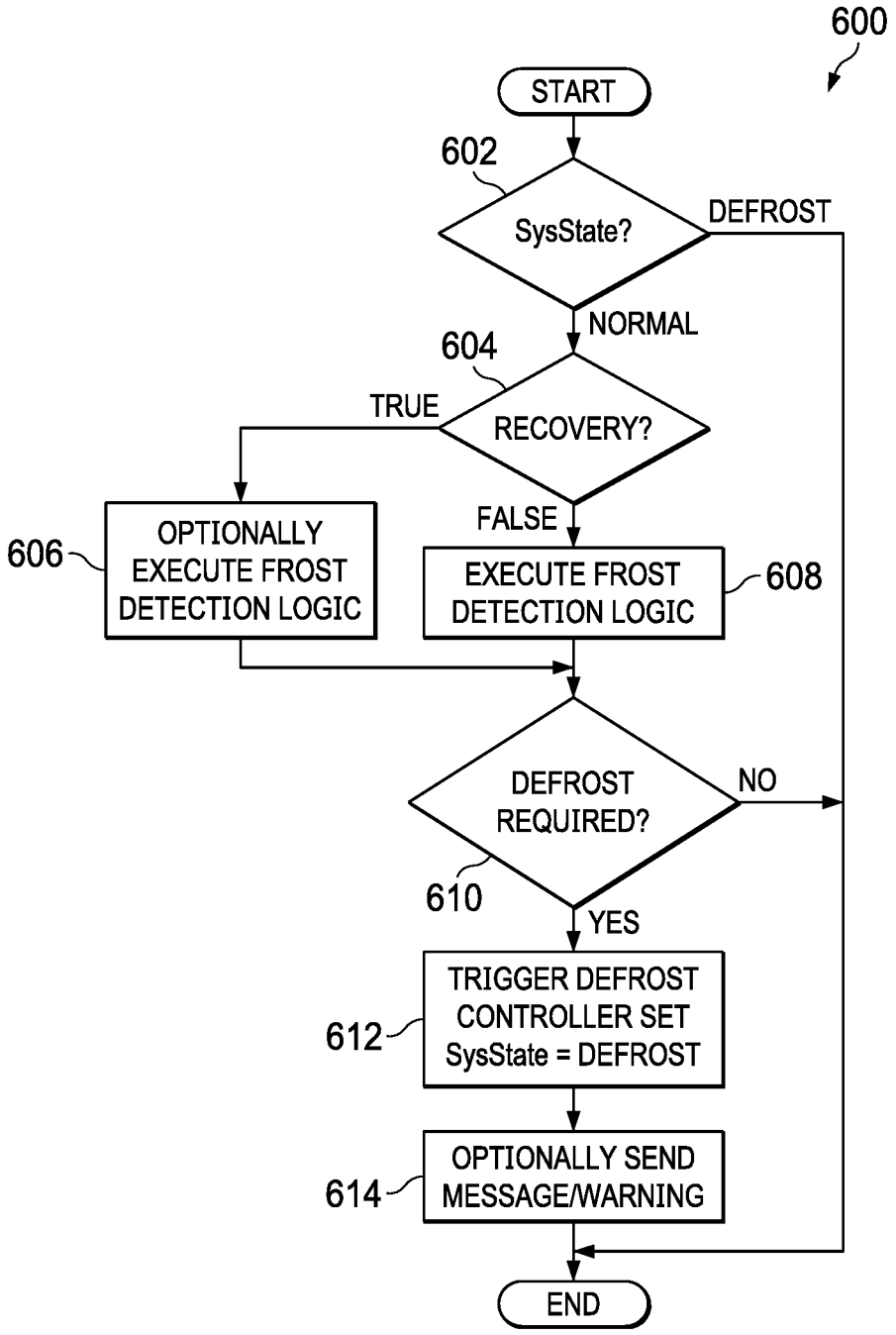
FIG. 6 illustrates an exemplary method that may be used to detect ice or frost conditions according to aspects of the disclosed embodiments.

Discussion of the operation of the frost condition detection processor 312 to detect and mitigate evaporator frost and ice build-up on an HVAC&R evaporator coil is assisted by the exemplary flow chart 600 of FIG. 6. In the example, the frost condition detection processor 312 is operated each time a new data record is received from the data acquisition processor 301. Upon entry to the routine, in decision block 602, the frost condition detection processor checks the SysState state variable. If SysState has the value "Defrost," the HVAC&R system is presently defrosting and no further action is taken by the frost condition detection processor. Assuming SysState has the value "Normal," in decision block 602, control passes to decision block 604 where it is determined if a defrost recovery cycle is in effect. In some embodiments, it is assumed that frosting is not an issue during a defrost recovery cycle, but in any case, if the system is not in a defrost recovery cycle, i.e., the state variable Recovery has the value False, a frost detection logic 313 (see FIG. 3) is executed in process block 608. The frost detection logic 313 determines if the system has degraded due to frosting to the extent that a defrost cycle is warranted. Conversely, in some embodiments frost detection is performed even when the system is in a defrost recovery cycle, i.e., the state variable Recovery has the value True. This is captured by passing control to process block 606 with Recovery set to True, in which case the frost detection logic is executed optionally. Details of the frost detection logic will be described subsequently.

If the frost detection logic 313 determines that defrosting is not required, in decision block 610, the frost detection processor 312 has completed operations for the present data record and exits normally. If the frost detection logic 313 determines that a defrost is necessary (the "Y" path from decision block 610), control passes to process block 612, where the frost detection condition processor sends a signal to the defrost controller 316, which triggers the actual defrost cycle in the HVAC&R system, and sets the system state variable SysState to the value "Defrost." Control then passes to process block 614 where a message or warning is optionally sent to an operator or logged in a data log for posterity.

Referring now to process block 608 of FIG. 6 and optionally process block 606 in some implementations, the frost detection logic 313 determines whether the HVAC&R system performance has degraded due to frosting to the extent that defrosting is warranted. There are several ways in which the frost detection logic 313 can determine whether HVAC&R system performance has degraded due to frosting and to trigger a defrost cycle. In general, these methods include determining a defrost discriminant that indicates the extent of the efficiency degradation in the HVAC&R system. In some embodiments, the frost detection logic 313 may determine the defrost discriminant by determining the difference between the measured power parameter value and the power parameter value predicted by the compressor input power parameter model for one or more data records obtained when the equipment is in the Run state as defined above, the variable SysState is set to Normal and the VCCStable state is set to True. These data records are also referred to herein as normal, steady-state records and the difference between the measured and predicted power parameter value is also referred to herein as a deviation. In some embodiments, the deviation may be represented as dev(n) for the $n^{th}$ data record and given mathematically by:

$$\mathrm{dev}(n)=\mathrm{PP}(n)-\mathrm{PP_hat}(n) \tag{1}$$

where PP(n) is the measured value of the chosen power parameter and PP_hat(n) is the value predicted by the compressor input power parameter model. It is often beneficial to use a normalized version of the deviation, expressed as a percentage, and defined by:

$$\%\ dev(n) = 100\% \frac{dev(n)}{\text{PP_hat}(n)} \quad (2)$$

It will be understood that other representations of the deviation may be made without departing from the scope of the disclosed embodiments, such as the square of the deviation or normalized deviation and the like.

A positive value for dev(n) or % dev(n) means that the measured power parameter value is larger than that predicted by the compressor input power parameter model and is usually indicative of a reduction in the capacity of the system to reject heat from the condenser. A negative value for dev(n) or % dev(n) means that the measured power parameter value is less than that predicted by the compressor input power parameter model and is indicative of a reduction in the capacity of the system to absorb heat in the evaporator. One cause of this reduction in capacity to absorb heat is frosting or icing of the evaporator coils.

From the values of dev(n) and % dev(n), several ways exist for determining a defrost discriminant. In some embodiments, the frost detection logic 313 compares the normalized percent deviation % dev(n) of the normal, steady-state records to a threshold percent deviation, % devTH, such as −5%, −10%, −15% and the like. The defrost discriminant may then be determined by counting the number of normal steady-state data records in a row, n-dev, that exceeds the threshold value % devTH. For example, in a frost monitor that produces one data record per minute and there are 10 steady-state records in a row with deviations greater (i.e., more negative) than a % devTH of −10%, then the defrost discriminant n-dev is 10. If the defrost discriminant exceeds a predefined defrost discriminant limit ndTH (e.g., 5, 10, 15, 20, etc.), this might indicate a condition that requires defrosting and the frost detection logic 313 may declare that defrosting is needed. An additional or alternative criterion might be 5 steady-state records in a row with deviations greater (i.e., more negative) than a % devTH of −20%, in which case the defrost discriminant n−dev is 5. In some embodiments, these two tests may be applied to the same sequence of data records and if either test result (i.e., n−dev1 or n−dev2) indicates the necessity to defrost, the defrost detection logic 313 can initiate a defrost cycle. In some implementations, the defrost detection logic can require that the normal, steady-state records be contiguous in time, i.e., within the same compressor cycle. In other implementations, the frost detection logic can ignore non-steady-state data records, thereby allowing the frost detection logic to work across two or more compressor cycles.

In another embodiment, the frost detection logic 313 may define a sliding defrost detection window of N data records for which the VCCStable state variable is set to the value of True. The defrost discriminant may then be determined by determining how many of these data records, Ndev, whether consecutive or not, represent operation with percent deviation % dev(n) below a % devTH of, say −5%, −10% or the like. If the number of data records meeting this criterion, i.e., the defrost discriminant Ndev, exceeds a threshold, for example NdevTH, the defrost detection logic 313 signals for a defrost cycle to be triggered. This method does not require a contiguous stream of data records with deviations below the threshold, only that m out of N data records meet the criterion, where m is a chosen number, and N is a number that represents the total number of data records (steady-state or not) expected over the defrost detection window or chosen interval. This method could be extended to calendar time by simply declaring the sliding window to be the total number of data records within a fixed window in calendar time and only counting the data records within that window in calendar time meeting the criterion above in Ndev.

In still another embodiment, the frost detection logic 313 may define a sliding defrost detection window of N data records for which the VCCStable state variable is set to True in time. The defrost discriminant may then be determined by integrating or summing the deviation percentage computed % dev(n) for each data record in the window to produce a sum of the deviation Sdev over the window. The defrost detection logic 313 declares defrosting is necessary if the sum of the deviation, Sdev, over the sliding window exceeds a pre-defined threshold sum SdevTH (e.g., 100%, 200%, 300%, etc.). For example, assuming the deviation is expressed in percent (% dev(n)), a new data record is received once per minute and a sliding window of 120 samples (120 minutes or two hours) is used, a pre-defined threshold sum of 225% would be matched by an HVAC&R system in which 45 of the 120 samples deviated by 5%. This method can be readily extended to calendar time by declaring the deviation of any data record within the calendar time window that does not meet the test {VCCStable=True} to zero, summing the total resulting deviation and comparing it against a threshold sum value.

Other such logical tests, such as comparing the square of deviations against a threshold, could be devised that fall within the scope of the disclosed embodiments.

In the foregoing examples, the defrost management processor 314 (see FIG. 3) maintains the timing of the defrost process, including the SysState and Recovery state variables defined above. Description of the operation of this processor is facilitated by the flow chart 700 of FIG. 7, which is executed either continuously or regularly, preferably timed to the receipt of new data records from the data acquisition processor 301. Recall that in a refrigerator/freezer application, the defrost process is generally a timed process, whereas in a heat pump application, the defrost process is generally not timed. Accordingly, a real or virtual input to the defrost management processor 314 is required representing the state of the defrost controller 316, which is assumed to have the value "On" if the defrost controller is actively defrosting and "Off" if it is not.

Figure 7:
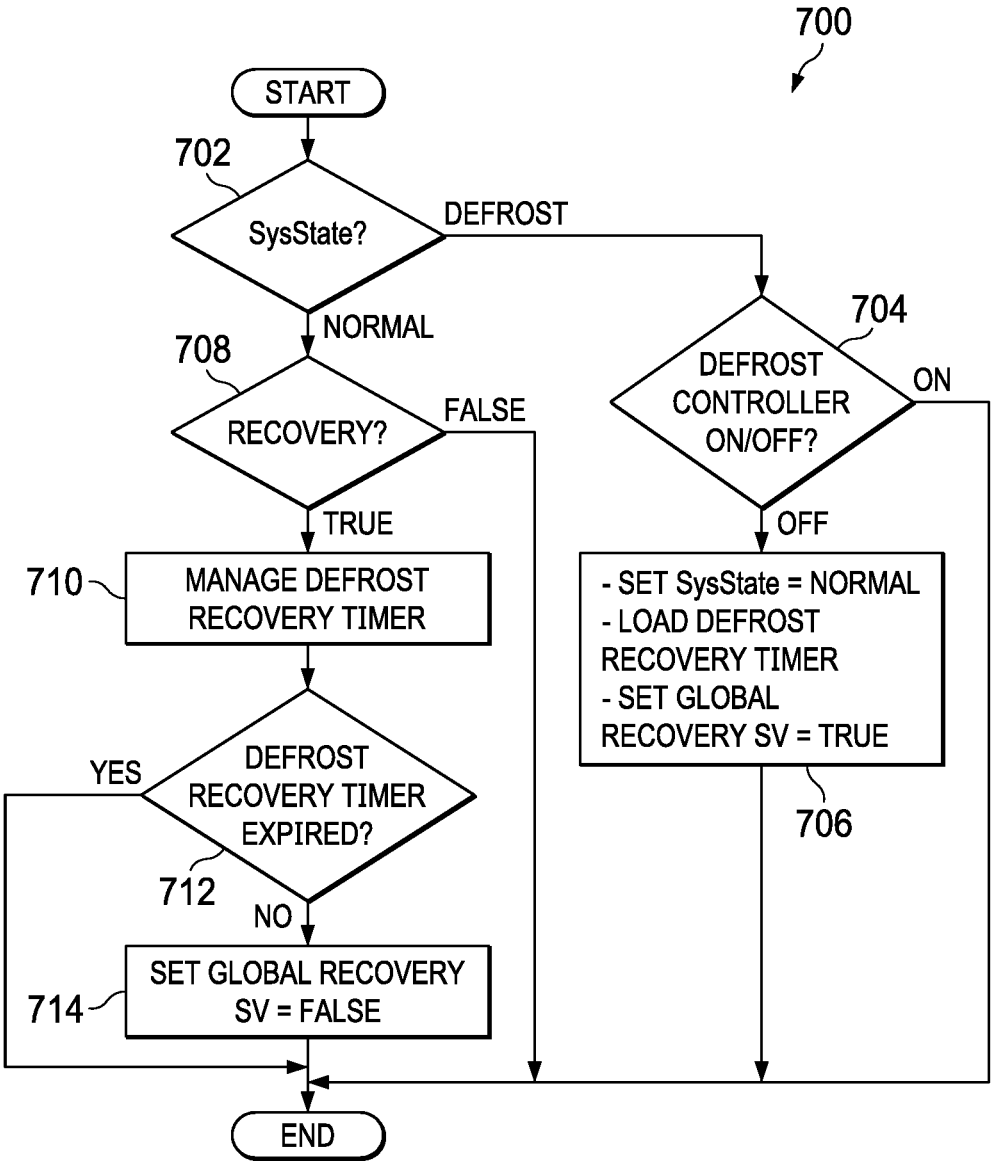
FIG. 7 illustrates an exemplary method that may be used to manage defrosting according to aspects of the disclosed embodiments.

Referring to FIG. 7, upon entry at decision block 702, the system branches dependent upon the value of SysState. If the system is in a defrost cycle (SysState=Defrost), then in decision block 704 the defrost management processor 314 examines the state of the defrost controller 316 to determine if the defrost controller is still "On" indicating it is still defrosting. If at decision block 704 it is determined that the system is still in a defrost cycle (the defrost controller 316 is still in an "On" state), the defrost management processor 314 exits normally for this cycle.

If in decision block 704 it is observed that the defrost controller is now "Off," the defrost cycle is now complete. In process block 706 the defrost management processor 314 sets the global SysState state variable to the value "Normal" in response, indicating that the system is no longer in the defrost state, loads the defrost recovery timer with the recovery time and sets the global Recovery state variable to the value "True" to indicate that the system is now in a defrost recovery cycle. The defrost management processor 314 thereafter exits the routine normally.

If in decision block 702 it is determined that the system is not in a defrost cycle, i.e., SysState is set to the value "Normal," then in decision block 708, the defrost management processor 314 checks to see if the system is in a defrost recovery cycle as indicated by the global Recovery state variable. If not (Recovery=False), then the defrost management processor 314 exits the routine normally.

In the example above, the defrost management processor 314 manages the defrost recovery timing for the frost detection and management processor 308. If the system is in the defrost recovery mode (Recovery="True" in decision block 708), the defrost management processor 314 manages the defrost recovery timer in process block 710 and checks to see if the defrost recovery time has expired in decision block 712. If the defrost recovery time has not yet expired in decision block 712, the defrost management processor 314 exits normally. If the defrost recovery time has expired, then in process block 714 the defrost management processor 314 sets the value of the Recovery state variable to "False," signifying completion of the defrost recovery cycle and exits normally.

In the foregoing embodiments, the compressor input power parameter model used by the frost condition detection processor 312 may comprise one or more temperature measurements and a parametric value for at least one of the temperature measurements. In one exemplary embodiment, the temperature measurements are the evaporator and condenser intake temperature measurements $T_{ci}$ and $T_{ei}$ and the model is a current based model that may be expressed in the form shown by Equation (1):

$$\hat{I} = \sqrt{k_0 + k_e T_{ei} + k_c T_{ci} + k_{e2}(T_{ei}^2) + k_{c2}(T_{ci}^2) + k_{ec} T_{ei} T_{ci}} \quad (3)$$

In Equation (3), $\hat{I}$ is the estimated compressor input current; $T_{ei}$ is the temperature at or near the evaporator intake; $T_{ci}$ is the temperature at or near condenser intake; $k_0$ is a baseline current intended to represent the current at the initial system operating point ($T_{ei}$=0, $T_{ci}$=0) in the units of temperature employed; $k_e$ is a sensitivity parameter representing the sensitivity of $\hat{I}^2$ to $T_{ei}$; $k_c$ is a sensitivity parameter representing the sensitivity of $\hat{I}^2$ to $T_{ci}$; $k_{e2}$ is a sensitivity parameter representing the sensitivity of $\hat{I}^2$ to the square of $T_{ei}$; $k_{c2}$ is a sensitivity parameter representing the sensitivity of $\hat{I}^2$ to the square of $T_{ci}$; and $k_{ec}$ is a sensitivity parameter representing the sensitivity of $\hat{I}^2$ to the product of $T_{ei}$ and $T_{ci}$. These condenser and evaporator intake fluid temperatures $T_{ei}$ and $T_{ci}$ may be obtained from sensor measurements, whereas the parametric values $k_0$, $k_c$, $k_e$, $k_{c2}$, $k_{e2}$, and $k_{ec}$ are derived or learned in the manner described above using the temperature measurements $T_{ci}$ and $T_{ei}$ and the compressor input current. The model also assumes that the line voltage remains constant and that the magnetizing current of the compressor motor 104*a* (see FIG. 1) may be modeled as a constant.

Figure 8:
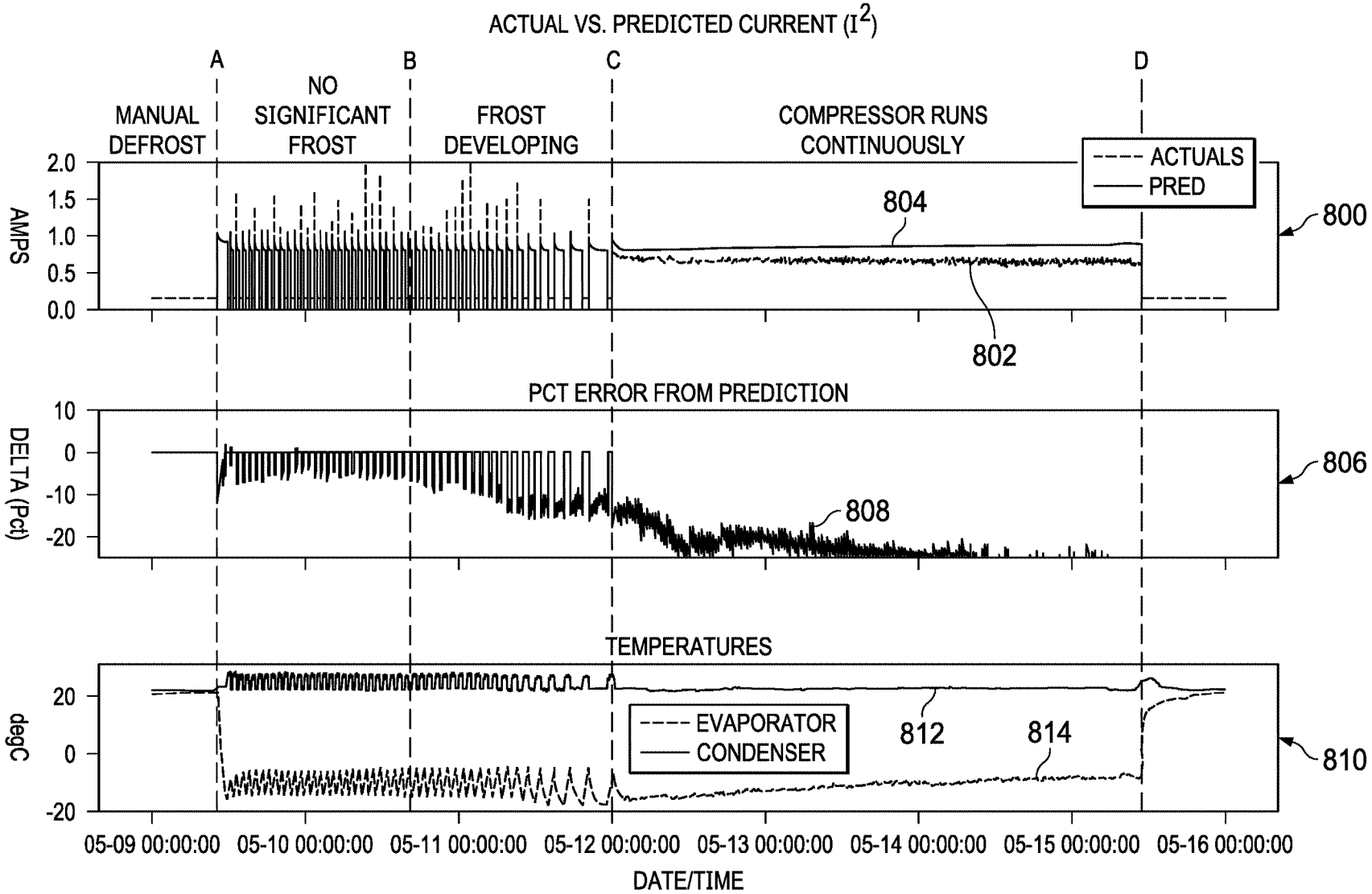
FIG. 8 is a chart comparing actual compressor input current versus compressor input current predicted by the frost monitor.

FIG. 8 graphically illustrates an example of how the frost condition detection processor 312 may employ the model expressed in Equation (1) to monitor and detect efficiency degradation. As can be seen, the frost condition detection processor 312 is using the model to produce expected values of instantaneous compressor input current over an 8-day interval starting May 9 and ending May 16. The frost condition detection processor 312 then compares these expected values to measurements of observed or actual compressor input current. The measurements in the example are obtained from a refrigeration system (e.g., residential refrigerator), so the temperatures represent air temperatures at the evaporator (e.g., freezer compartment) and condenser (e.g., external ambient) intakes.

Several charts can be seen in FIG. 8, including a first chart 800 showing the actual current (line 802) consumed by the compressor versus $\hat{I}$, the predicted current (line 804) in Amps; a second chart 806 showing the percent difference or residual (line 808) between the actual and predicted current; and a third chart 810 showing the condenser intake temperature (line 812) and evaporator intake temperature (line 814) in degrees over the operating interval on which the predicted power values were based. Letters "A" through "D" mark various periods of operation of the refrigeration system, with the system being turned off after D.

As the first chart 800 shows, the actual current consumed by the compressor (line 802) largely tracks the current predicted by the model (line 804) during the period between A and B, with deviations (line 808) of less than 10% after a short initial transient start-up period while the system stabilizes. These less than 10% deviations may indicate inefficient equipment operation, but no significant icing or frost development, so the frost condition detection processor 312 need not notify or signal the defrost controller 316 at this time. During the period between B and C, the deviations gradually increase to about 15%, which may indicate the beginnings of ice or frost accumulation on the evaporator coils. If the frost condition detection processor 312 determines that defrosting is needed during this interval, for example by comparing % dev(n) to % devTH as discussed in blocks 608 and 610 in FIG. 6, then it may send a signal or otherwise notify the defrost controller 316. During the period between C and D, the deviations increase to beyond 20%, indicating the evaporator coils have loss significant heat transfer capacity, likely as a result of ice or frost accumulation, and the compressor is running nearly continuously to compensate. Again, if the frost condition detection processor 312 determines that defrosting is needed during this interval as discussed in blocks 608 and 610 in FIG. 6, then it may send a signal or otherwise notify the defrost controller 316.

Figure 9:
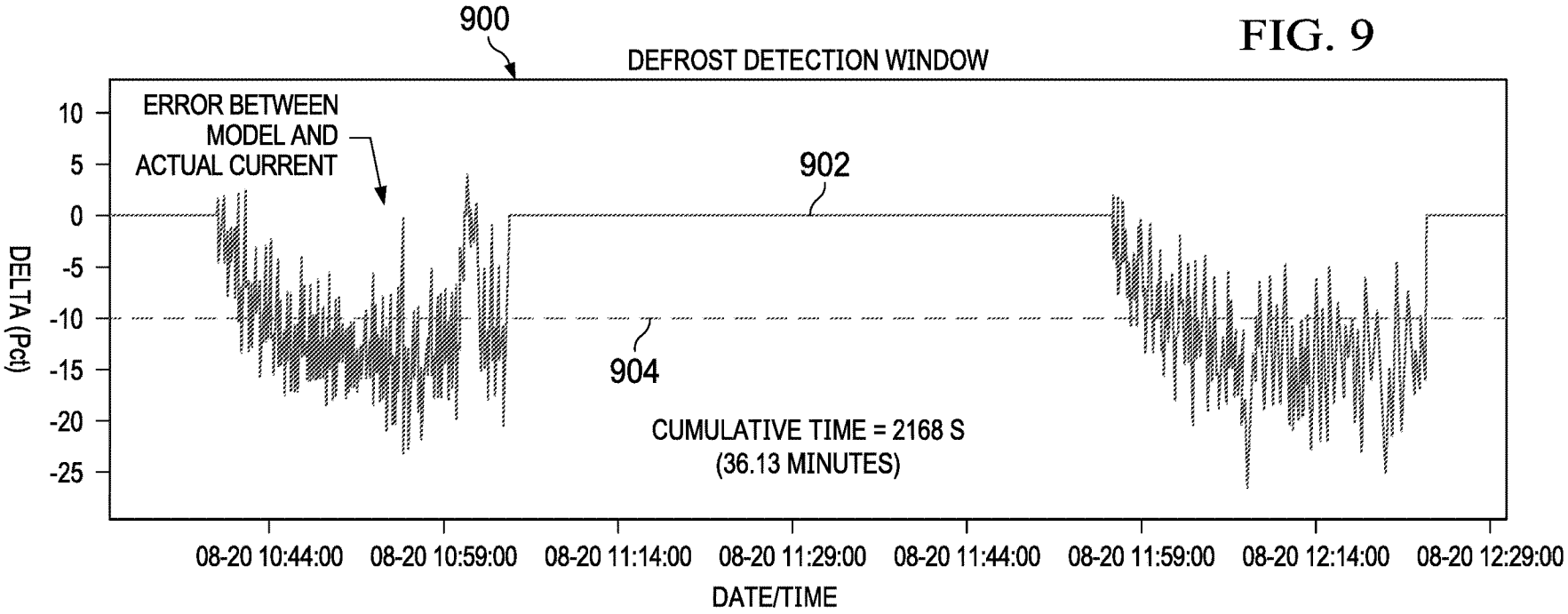
FIG. 9 is a chart showing an exemplary defrost detection window that may be used by the frost monitor.

FIG. 9 illustrates a chart 900 representing an exemplary defrost detection window that may be used by the frost condition detection processor 312 (and the defrost detection logic 313 therein) to determine whether to initiate defrosting of the system. The chart 900 spans about a 2-hour interval of calendar time and shows the percent difference or residual (line 902) between the actual or observed compressor input current and the current predicted by the model in Equation (3). In this example, deviations % dev that exceed the predefined threshold % devTH, about −10% (line 904) in this embodiment, within the 2-hour defrost detection window are the ones that are used by the frost condition detection processor 312 to determine a defrost discriminant in the various ways described above. The frost condition detection processor 312 (or the defrost detection logic 313 therein) may then determine whether to initiate defrosting based on whether the resulting defrost discriminant exceeds a predefined defrost discriminant limit. In another alternative embodiment, the frost condition detection processor 312 (or the defrost detection logic 313 therein) may determine the defrost discriminant by calculating the cumulative deviation time that exceed the predefined threshold % devTH. If the cumulative deviation time exceeds the predefined threshold % devTH, which may be about 45 minutes, then the defrost initiation processor 314 initiates defrosting. Other preset limits may also be used, such as 30 minutes, 60 minutes, 90 minutes, and the like, without departing from the scope of the disclosed embodiments. In the example shown here, the cumulative deviation time comes to about 36 minutes (2168 seconds), which is less than the 45-minute limit so defrosting is not initiated.

As can be seen from the foregoing, embodiments of the frost monitor disclosed herein is capable of monitoring and detecting efficiency degradations indicative of icing or frost conditions on HVAC&R system coils. The disclosed frost monitor may detect the efficiency degradations by comparing one or more compressor input power parameters estimated by a model against actual or observed values. For purposes of monitoring and detecting icing or frost conditions, the one or more compressor input power parameters may be current. Deviations from the estimated value above a predefined threshold may be used to compute a defrost discriminant by determining a cumulative deviation time within a predefined defrost detection window. If the defrost discriminant is greater than a preset limit, defrosting of the system may be triggered.

Figure 10:
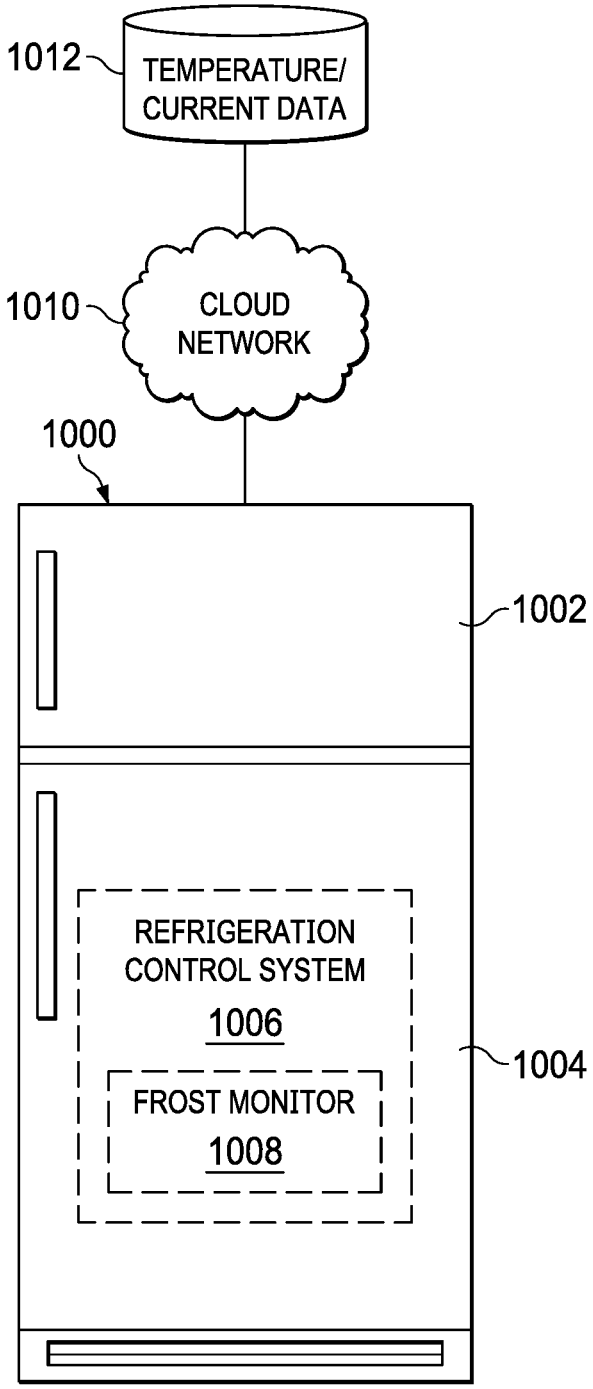
FIG. 10 illustrates an exemplary refrigeration system equipped with a frost monitor according to aspects of the disclosed embodiments.

Alternatively, the frost monitor may download or otherwise obtain previously stored parametric values for the system from a network, cloud storage, or other storage location (see FIG. 10).

FIG. 10 illustrates an exemplary HVAC&R system 1000 equipped with a frost monitor according to the disclosed embodiments. The HVAC&R system 1000 in this example resembles a typical residential refrigerator and includes a freezer compartment 1002 and fresh food compartment 1004. A refrigeration control system 1006 of the refrigerator 1000 monitors and maintains the freezer compartment 1002 and the fresh food compartment 1004 at user-selected temperatures. Temperature sensors (not expressly shown) mounted in specific locations on the refrigerator 1000 provide the refrigeration control system 1006 with temperature measurements. Similarly, one or more current sensors (not expressly shown) mounted around a power line provides the refrigeration control system 1006 with current measurements. The current sensors may be split-core current transformers in some embodiments that can detect the current delivered to the refrigerator 1000 over the power line.

In accordance with the disclosed embodiments, a frost monitor 1008 may be provided for the refrigerator 1000, either as a standalone monitor or integrated within the refrigeration control system 1006. The frost monitor 1008 may be provided with and may use some or all of the same temperature measurements and current measurements as the refrigeration control system 1006. Such a frost monitor 1008 may then be operated in the manner described above to adaptively defrost the refrigerator 1000 based on the operational efficiency, or degradation thereof, of the refrigerator 1000. In some embodiments, temperature measurements from the temperature sensors and/or the current measurements from the current sensors may also be transmitted and stored on a network 1010, such as a cloud-based database 1012. The refrigeration control system 1006 and/or the frost monitor 1008 may then access the network 1010 to retrieve the measurements, and may likewise store or otherwise make other data (e.g., system on time, system off time, error status, etc.) available on the network 1010.

As can be seen, the embodiments disclosed herein provide a number of advantages, including a direct indication of whether coil icing or frosting conditions are present in an HVAC&R system. Defrosting may then be delayed until truly necessary. This can extend the life of system equipment while simultaneously reducing energy cost. It also provides a way to significantly improve efficiency of heat pump systems by deferring defrosting until a loss of heat transfer capacity is observed. Other benefits of the disclosed embodiments include the use of an instantaneous reduction in observed compressor input power parameters with respect to expected values as an indication of a loss of heat absorption capacity by a vapor compression cycle system. The loss of heat transfer capacity may be an indication that a defrost cycle is necessary. Conversely, when observed compressor input power parameters match expected values again, this may be in indication that heat transfer capacity has returned and defrosting is no longer necessary.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the scope of the invention as defined in the appended claims.

What is claimed is:

1. A frost monitor for a heating, ventilating, and air conditioning and refrigeration (HVAC&R) system having a compressor, a condenser, and an evaporator, comprising: a system temperature processor operable to obtain fluid temperature measurements for the condenser and fluid temperature measurements for the evaporator, the fluid temperature measurements for the condenser and the evaporator being obtained from temperature sensors located near the condenser and the evaporator, respectively, or from proxies of the fluid temperature measurements for the condenser and for the evaporator, respectively; a power parameter processor operable to obtain one or more power parameter measurements for the compressor using one or more current detection devices mounted on the compressor, respectively; and a frost condition detection processor operable to provide an estimate of a compressor input power parameter for the compressor using the fluid temperature measurements and the one or more power parameter measurements; wherein the frost condition detection processor is configured to detect degradation of operational efficiency in the HVAC&R system using the estimate of the compressor input power parameter and the one or more power parameter measurements and initiate defrosting of the HVAC&R system based on degradation of operational efficiency being detected in the HVAC&R.

2. The frost monitor of claim 1, wherein the frost condition detection processor is configured to detect degradation of operational efficiency in the HVAC&R system by comparing the estimate of the compressor input power parameter to the one or more power parameter measurements and, if the one or more power parameter measurements deviate from the estimate of the compressor input power parameter by a deviation that is more than a predefined amount, calculating a defrost discriminant using the deviation, the defrost discriminant indicating a degree of degradation of operational efficiency in the HVAC&R system.

3. The frost monitor of claim 2, wherein the frost condition detection processor is further configured to initiate defrosting of the HVAC&R system if the defrost discriminant exceeds a preset limit, the frost condition detection processor configured to calculate the defrost discriminant based on one of: a total number of deviations over a predefined detection window, a total number of consecutive deviations over a predefined detection window, a total deviation percentage over a predefined detection window, or a cumulative deviation time over a predefined detection window.

4. The frost monitor of claim 3, wherein the frost condition detection processor estimates the compressor input power parameter by modeling the compressor input power parameter using a baseline power component and at least one fluid temperature sensitivity component.

5. The frost monitor of claim 4, wherein the at least one fluid temperature sensitivity component comprises at least one sensitivity parameter multiplied by at least one fluid temperature measurement, the at least one sensitivity parameter indicating a sensitivity of a square of the compressor input power parameter to the at least one fluid temperature measurements.

6. The frost monitor of claim 5, wherein the at least one sensitivity parameter comprises:

a first condenser sensitivity parameter that indicates a sensitivity of a square of the compressor input power parameter to the fluid temperature measurements for the condenser;

a first evaporator sensitivity parameter that indicates a sensitivity of a square of the compressor input power parameter to the fluid temperature measurements for the evaporator;

a second condenser sensitivity parameter that indicates a sensitivity of a square of the compressor input power parameter to a square of the fluid temperature measurements for the condenser;

a second evaporator sensitivity parameter that indicates a sensitivity of a square of the compressor input power parameter to a square of the fluid temperature measurements for the evaporator; and a combined sensitivity parameter that indicates a sensitivity of a square of the compressor input power parameter to a product of the fluid temperature measurements for the condenser and the fluid temperature measurements for the evaporator.

7. The frost monitor of claim 5, wherein the at least one fluid temperature measurements includes one or more of condenser intake fluid temperature measurements and condenser exhaust temperature measurements and one or more of evaporator intake fluid temperature measurements and evaporator exhaust temperature measurements.

8. The frost monitor of claim 5, wherein the frost condition detection processor is further configured to derive the at least one sensitivity parameter using the at least one fluid temperature measurement and the one or more power parameter measurements and derive at least one sensitivity parameter using at least one fluid temperature measurement and the one or more power parameter measurements.

9. The frost monitor of claim 1, wherein the frost condition detection processor is further configured to start a defrost recovery timer and to initiate defrosting of the HVAC&R system based on degradation of operational efficiency being detected in the HVAC&R after the defrost recovery timer has completed.

10. The frost monitor of claim 9, wherein the frost condition detection processor is further configured to detect degradation of operational efficiency in the HVAC&R system after defrosting is completed and issue an audio/visual warning and/or an alert message if degradation of operational efficiency in the HVAC&R system is detected within a predefined period after defrosting is completed.

11. The frost monitor of claim 1, wherein the one or more power parameter is current.

12. A method of detecting coil frosting conditions in a heating, ventilating, and air conditioning and refrigeration (HVAC&R) system having a compressor, a condenser connected to the compressor, and an evaporator connected to the condenser, the method comprising: obtaining fluid temperature measurements for the condenser and fluid temperature measurements for the evaporator, the fluid temperature measurements for the condenser and the evaporator being obtained from temperature sensors located near the condenser and the evaporator, respectively, or from proxies of the fluid temperature measurements for the condenser and the evaporator, respectively; obtaining one or more power parameter measurements for the compressor using one or more current detection devices mounted to detect current flowing into the compressor; estimating a compressor input power parameter for the compressor using the fluid temperature measurements and the one or more power parameter measurements; detecting degradation of operational efficiency in the HVAC&R system using the estimate of the compressor input power parameter and the one or more power parameter measurements; and initiating defrosting of the HVAC&R system based on degradation of operational efficiency being detected in the HVAC&R.

13. The method of claim 12, wherein detecting degradation of operational efficiency in the HVAC&R system comprises comparing the estimate of the compressor input power parameter to the one or more power parameter measurements and, if the one or more power parameter measurements deviate from the estimate of the compressor input power parameter by a deviation that is more than a predefined amount, determining a defrost discriminant using the deviation, the defrost discriminant indicating a degree of degradation of operational efficiency in the HVAC&R system.

14. The method of claim 12, further comprising initiating defrosting of the HVAC&R system if the defrost discriminant exceeds a preset limit, wherein the defrost discriminant is determined based on one of: a total number of deviations over a predefined detection window, a total number of consecutive deviations over a predefined detection window, a total deviation percentage over a predefined detection window, or a cumulative deviation time over a predefined detection window.

15. The method of claim 14, wherein estimating the compressor input power parameter comprises modeling the compressor input power parameter using a baseline power component and at least one fluid temperature sensitivity component.

16. The method of claim 15, wherein the at least one fluid temperature sensitivity component comprises at least one sensitivity parameter multiplied by at least one fluid temperature measurement, the at least one sensitivity parameter indicating a sensitivity of the compressor input power parameter to the at least one fluid temperature measurements.

17. The method of claim 16, wherein the at least one sensitivity parameter comprises:

a first condenser sensitivity parameter that indicates a sensitivity of a square of the compressor input power parameter to the fluid temperature measurements for the condenser;

a first evaporator sensitivity parameter that indicates a sensitivity of a square of the compressor input power parameter to the fluid temperature measurements for the evaporator;

a second condenser sensitivity parameter that indicates a sensitivity of a square of the compressor input power parameter to a square of the fluid temperature measurements for the condenser;

a second evaporator sensitivity parameter that indicates a sensitivity of a square of the compressor input power parameter to a square of the fluid temperature measurements for the evaporator; and a combined sensitivity parameter that indicates a sensitivity of a square of the compressor input power parameter to a product of the fluid temperature measurements for the condenser and the fluid temperature measurements for the evaporator.

18. The method of claim 16, wherein the at least one fluid temperature measurements includes one or more of condenser intake fluid temperature measurements and condenser exhaust temperature measurements and one or more of evaporator intake fluid temperature measurements and evaporator exhaust temperature measurements.

19. The method of claim 16, further comprising deriving the at least one sensitivity parameter using the at least one fluid temperature measurement and the one or more power parameter measurements and deriving at least one sensitivity parameter using at least one fluid temperature measurement and the one or more power parameter measurements.

20. The method of claim 12, further comprising starting a defrost recovery timer and initiating defrosting of the HVAC&R system based on degradation of operational efficiency being detected in the HVAC&R after the defrost recovery timer has completed.

21. The method of claim 20, further comprising detecting degradation of operational efficiency in the HVAC&R system after defrosting is completed and issuing an audio/visual warning and/or an alert message if degradation of operational efficiency in the HVAC&R system is detected within a predefined period after defrosting is completed.

22. The method of claim 12, wherein the one or more power parameter is current.

* * * * *